US006533040B2

(12) United States Patent
Gondouin

(10) Patent No.: US 6,533,040 B2
(45) Date of Patent: Mar. 18, 2003

(54) MULTI-FUNCTION APPARATUS FOR ADDING A BRANCH WELL SEALED LINER AND CONNECTOR TO AN EXISTING CASED WELL AT LOW COST

(76) Inventor: Michael Gondouin, 32 San Marino Dr., San Rafael, CA (US) 94901

( * ) Notice: Subject to any disclaimer, the term of this patent is extended or adjusted under 35 U.S.C. 154(b) by 0 days.

(21) Appl. No.: 09/728,668

(22) Filed: Dec. 1, 2000

(65) Prior Publication Data

US 2003/0034156 A1 Feb. 20, 2003

Related U.S. Application Data

(60) Provisional application No. 60/168,929, filed on Dec. 3, 1999.

(51) Int. Cl.[7] ..... E21B 19/16

(52) U.S. Cl. ..... 166/380; 166/50; 166/55.1; 175/4.5

(58) Field of Search ..... 166/50, 117.6, 166/241.1, 313, 380, 55, 55.1, 63; 175/4.5, 4.51, 79, 80

(56) References Cited

U.S. PATENT DOCUMENTS

| | | | | |
|---|---|---|---|---|
| 4,009,757 A | * | 3/1977 | Vann | 166/276 |
| 4,637,478 A | * | 1/1987 | George | 175/4.51 |
| 6,070,667 A | * | 6/2000 | Gano | 166/313 |
| 6,189,616 B1 | * | 2/2001 | Gano et al. | 166/298 |
| 6,241,021 B1 | * | 6/2001 | Bowling | 166/380 |

* cited by examiner

*Primary Examiner*—Frank S. Tsay
(74) *Attorney, Agent, or Firm*—George W. Wasson

(57) ABSTRACT

A multi-function apparatus designated as a "Liner Stub Assembly", run in and set in an existing cased well at the end of a work pipe string is used to add a liner-equipped branch well to an existing cased well in a way which provides full access to both wells. Pre-fabricated mobile straight tubular connectors (Liner Stubs) are installed and sealed by on-board explosive means which accurately cut a window of pre-determined shape and dimensions in the existing well casing and weld to it the Liner Stub's stop collar to make downhole a leak-proof tubular junction of the two wells, by means of such short connectors.

12 Claims, 15 Drawing Sheets

FIG. 1
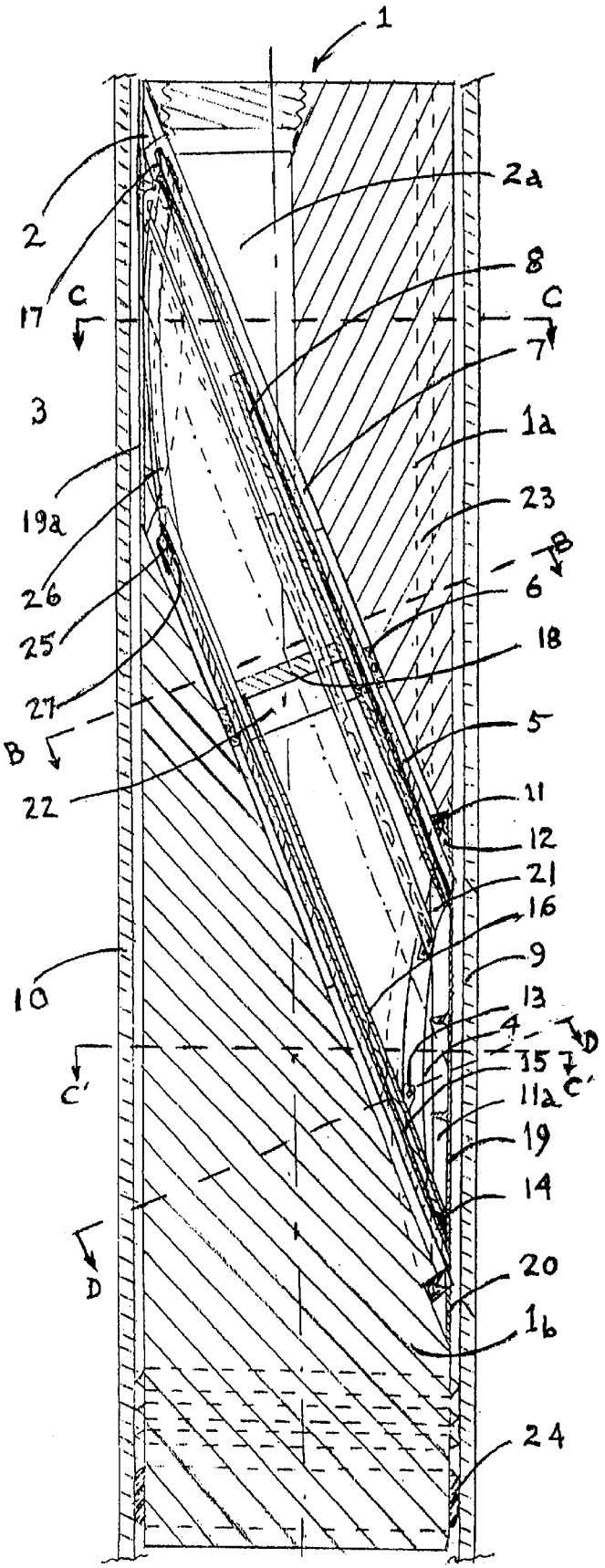
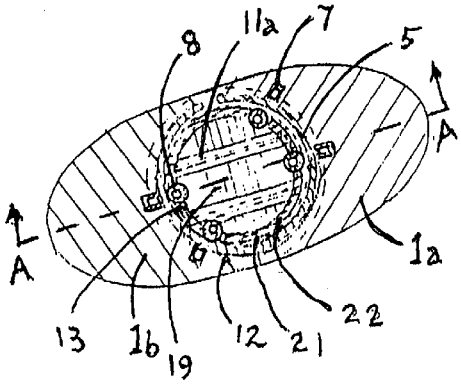
FIG. 1a

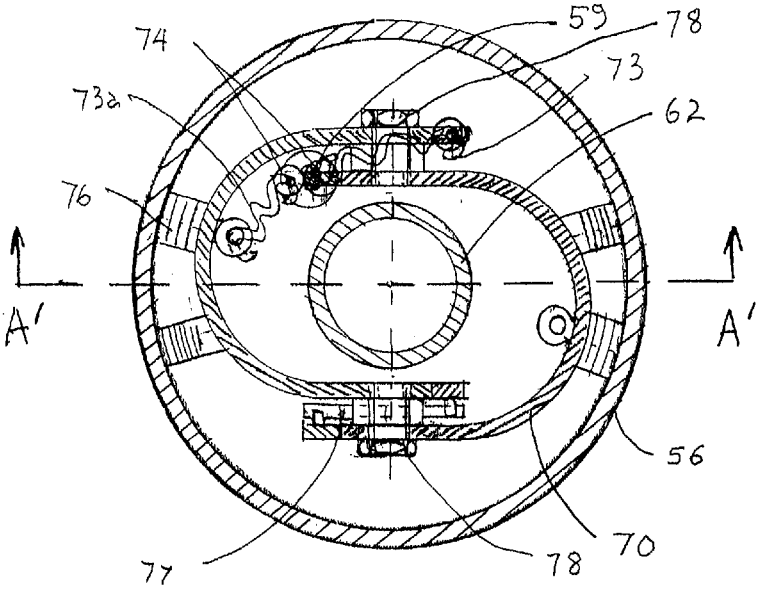
FIG. 22 AA
FIG. 22 A
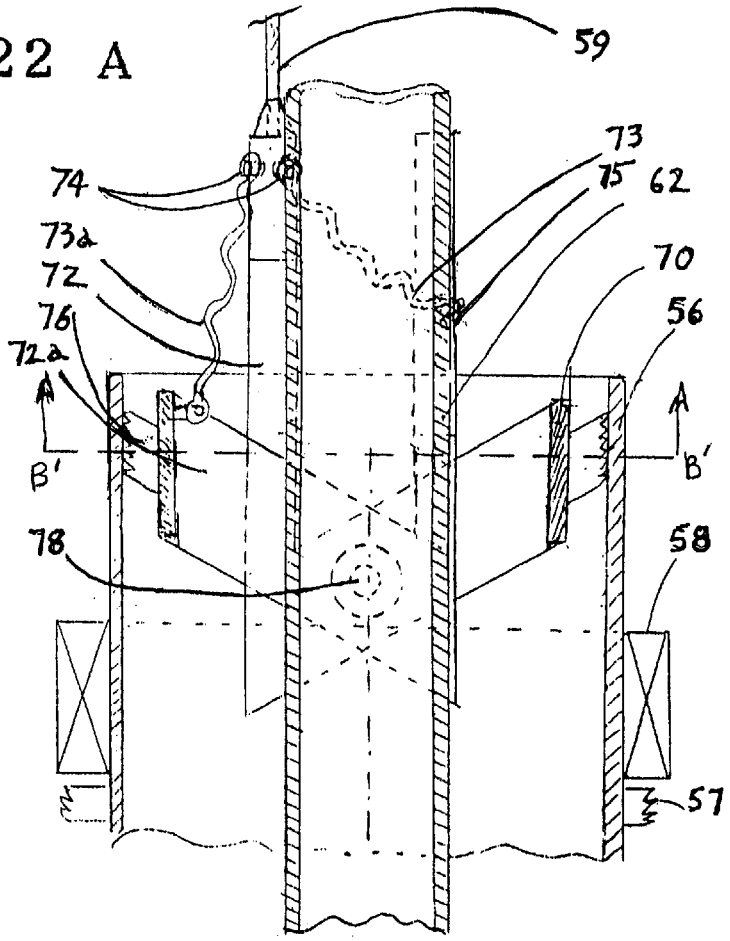

MULTI-FUNCTION APPARATUS FOR ADDING A BRANCH WELL SEALED LINER AND CONNECTOR TO AN EXISTING CASED WELL AT LOW COST

This application claims priority from Provisional Application 60/168,929, filed Dec. 3, 1999, for MULTI-FUNCTION APPARATUS FOR ADDING A BRANCH WELL SEALED LINE CONNECTION TO AN EXISTING CASED WELL AT LOW COST.

FIELD OF THE INVENTION

In many mature Oil fields, most existing low-productivity wells, also called "stripper wells", become un-economic when oil prices drop below $14/B, thus causing their premature abandonment and the loss of their remaining Petroleum reserves. To prevent this loss of a precious Natural Resource, it is necessary to boost the wells productivity at low Capital Cost, without any significant increase of the wells Operating Cost.

A proven method of reaching the objective of an increased well productivity is to convert single wells into multi-lateral wells. These drain a larger area of the reservoir, either because the added branch well is drilled into a different layer or because it is highly deviated to reach an un-depleted region of the original productive layer. Various types of downhole sealed connectors have been described and claimed in U.S. Pat. No. 5,462,120, but the present Invention is especially applicable to existing wells equipped with a casing of outside diameter ranging from 7⅝" to 6.5" and cemented or not at the lateral kick-off point. The prefabricated Assembly is designed so as to minimize the cost of its installation in the existing well, by reducing the required rig time, while providing both a reliable sealed connection of the casing with the branch well liner and full access to the bottom of the casing, below the kick-off point. These two main features are required whenever the existing and branch wells are not at comparable pressures or temperatures, because of reservoir or fluid characteristics, or when the two wells must be operated independently of each other, for instance to convey different fluids, as in the configurations described and claimed in U.S. Pat. No. 5,085,279. These features are not achievable for existing wells of those sizes, using any presently available connecting equipment.

Furthermore, the use of the Assembly, in conjunction with a Combined Apparatus for jet-drilling, and for the liner completion of the branch well through the sealed connection, provides additional cost saving benefits, for which conventional drilling tools of the required small size are not well suited, especially in relatively soft formations.

SUMMARY OF THE INVENTION

The first step required for making a branch lateral connection to an existing cased well is that a window be cut-out in the casing to provide access to drill strings and completion tubulars required for the branch well. Performing this operation with a milling bit at the end of a drill string is a time-consuming task. It also results in an irregular window's edge providing a poor fit with the upper end of the branch well liner hung and sealed in a short connecting tube (called a liner stub).

The generally poor fit obtained between the liner stub and a conventionally milled-out casing window makes the sealed junction of the existing well with the new branch lateral entirely dependent upon the bonds between the steel of the two poorly fitting tubulars and the cement filling the gap between them.

The long-term integrity of such a cement to steel seal is unreliable when the well tubulars are subjected to cyclic stresses resulting from pressure or temperature variations at the junction of casing and liner stub, during operation of the dual well.

In addition to the high window-cutting cost, the conventional use of a succession of many different downhole tools requires many trips of the work string, which increase the total rig time and Capital cost of the work-over beyond the limit of affordability for marginal wells.

The present Invention addresses these problems by the design of a multi-function apparatus to be used in existing cased wells, called a "Liner Stub" Assembly, of outside diameter not exceeding the well casing drift diameter, such that said Assembly, used in the First, Second, Third and Fourth Embodiments of the Invention is designed to be:

1) factory pre-fabricated at low cost, from inexpensive drillable materials (except for the high-strength steel stub), including a housing equipped with an outer retrievable hanger-packer, and presenting an inner cavity containing said liner stub,
2) run-in, with the liner stub in a locked position, at the end of a 5" or 4.5" OD work string, oriented and set in the casing, preferably opposite a soft formation, all in a single trip, In addition, said multi-function Assembly allows:

3) the insertion of the stub in a casing window neatly cut-out, in a very short time, using cordon-type linear explosive shaped charges, all equipped with appropriate cutting liners, disposed in a template also included in the said Assembly, but armed at the well site,
4) the remains of the casing wall left in the window and other large debris to be removed by wireline fishing tools, through the work string and the Assembly housing,
5) a side pocket hole of approximate dimensions sufficient to contain the liner stub to be drilled, prior to the liner stub's full extension from the Assembly's housing cavity through the casing window into said pocket hole, in which a cement slurry is displaced outside the extended liner stub, by conventional means,
6) the liner stub, when un-locked and fully extended into said pocket hole, to be at a prescribed small angle (typically less than one degree) from the axis of said Assembly, by using an associated stub-guiding system, also included in said Assembly,
7) the cordons' sequential detonation, controlled by a surface-triggered firing system, included in said Assembly, to shatter the sand face within the cut-out window, followed by small-size debris removal to the surface by reverse circulation of the casing fluid, using flow channels included outside the housing of said Assembly, which may be used during the period of extension of the liner stub in said side pocket hole, and thereafter, during drilling and completion of the branch well,
8) a soft metal stop-collar, affixed at the annealed upper end of the liner stub during pre-fabrication of said Assembly, to reliably stop the liner stub's extension and to maintain said stub in close contact with the inner surface of the casing, along the window's edge, for re-inforcement of the casing and liner stub at their junction,
9) after full-extension of the stub, and displacement of a slug of cement slurry behind the stub in the hole, the guiding system of the liner stub and charge enclosure debris to be quickly retrieved, by wireline, directly through the work string and Assembly housing, or by drilling-out, using a smaller-diameter drill string, inserted in the work string, 10) secondary explosive charges, affixed to said liner upper end and protected by a drillable pressure-resistant annular enclosure to be independantly detonated by a second surface-triggered firing system, also included in said Assembly, as means of bonding the end of the liner stub and its metal collar to the casing, all along the window's edge to form an explosively-welded, reliably leak-proof, metal seal between the casing and liner stub metals, capable of withstanding considerable stress, 11) All debris from the explosions and some of the stub guiding systems are removed, but most of the Assembly housing in the First and Second Embodiments remains, still supported by the hanger-packer in the casing. It is now used as a guide for the insertion of cleaning, cementation and completion tools into the explosively-welded stub. Conversely, in the Third Embodiment, a cement slurry is squeezed around the windowed part of the casing, after all debris from the cover plate and from the cut casing have been removed through the bent liner stub. The welded and cemented curved liner stub is now ready to serve as a tool guide for drilling, cementation and completion of the branch well and as a sealed anchor for its liner.

After the cement slurry displaced behind the casing and the welded liner stub has set, the cement plug at the bottom of the stub is drilled through, so as to begin drilling and completion of the branch well. This is advantageously done by means of a jet-drilling and liner positioning Combined Apparatus, which still includes a large large portion of the Assembly housing, its support in the casing and the large-diameter work string, required to run it, and the liner stub itself, after it has been explosively-welded to the casing and cemented in place.

This Apparatus is disclosed as the Fourth Embodiment of the Invention. It also includes a mud circulation system and a buoyant spoolable tubular umbilical, co-axial with a segment of coiled liner inserted, through the work string, via the Assembly housing and the installed liner stub, into the branch borehole, while it is being drilled, using a jet-driling process, derived in part from U.S. Pat. No. 5,402,855.

EMBODIMENTS OF THE INVENTION

In a First Embodiment of the Invention, the Liner Stub Assembly, equipped with its stiffening internals, and its guiding system are preferably fabricated by the method disclosed in the Co-pending Pat. No. 6,065,209 (third embodiment).

In the Second Embodiment of the Invention, only the upper end of the Liner Stub, including its stiffening tie-rods, is fabricated by the method disclosed in the same Co-pending Patent.

In the Third Embodiment of the Invention, a Pre-curved Liner Stub Assembly and its associated by-pass tubing are used to reach even greater cost-saving objectives, but with a large reduction of the access to the original well bottom. This Pre-curved Liner Stub serves the same purpose as the straight Liner Stubs in the first two Embodiments, namely to provide an anchor and a sealed connection between the casing and the branch well liner.

Like the stubs of the First and Second Embodiments, the Pre-curved Liner Stub Assembly, including its stiffening internals, collar and cover plate are all fabricated by the method disclosed in said Co-pending Patent (see 4th embodiment of U.S. Pat. No. 6,065,209).

As in the first two Embodiments, the Pre-curved Liner Stub is explosively-welded to the casing, along the edge of the casing window, also cut with explosives, but their junction is now at the lower end, rather than at its upper end.

The Pre-curved Liner Stub, however, remains stationary within the casing, instead of being thrust into a side-pocket hole. This greatly simplifies its installation is the casing, but it also reduces access below the casing window. The only access to the casing space below the branch well is through a small-diameter by-pass tubing. Consequently, the Third Embodiment is applicable only to vertical cased wells of relatively low productivity.

Whereas the First Three Embodiments deal only with the Assembly used for constructing a branch connector, sealed to the casing of an existing well, the Fourth Embodiment deals with a combined Apparatus, including only a portion of the Assembly, the stub and the same work string. This Apparatus is used for drilling the branch borehole to its targeted depth, via the cemented connector, and for completion of the branch well with a coiled tubing liner.

This Combined Apparatus constitutes the Fourth Embodiment of the Invention.

It is used as tool guide, support and means of fluid circulation for the following three additional tasks of well construction:

12) drilling of the branch borehole, of diameter at least equal to that of the stub, preferably by means of a high-pressure jet, located at the end of a small diameter buoyant spoolable tubing, inserted in a segment of un-coiled metal liner terminated at its upper end by a tubing hanger and a packer, of diameter suitable for being set inside the cemented stub. The lower end of the liner is guided and supported in the highly-deviated hole, behind the drilling jet, by the buoyant lower end of the spoolable tubing. During the jet-drilling process, the respective penetrations of the liner segment and of the spoolable tubing are controlled hydraulically and mechanically from the surface, 13) after retrieval of the jet-drilling tools, the liner segment, suspended from the surface by a retrievable cable, is hung in the liner stub, gravel-packed, cemented and packed in the liner stub, ready for perforation by known means.

14) the suspension means of the liner, the work string, the remaining part of the Assembly and its retrievable support in the casing, are then removed, thus re-opening the casing above and below the window.

The dual well is then ready for installation of its tubings completion, by conventional means.

The use of said pre-fabricated stub Assembly, installed in a single trip of the work string, also provides cost-saving advantages for conventional operations included in the well work-over, subsequent to the explosive welding of the liner stub:

the same small-diameter drill string is used, in conjunction with the Assembly housing, to drill out excess cement in the stub and to begin drilling the deviated branch borehole via the welded stub. This may be done using either the rotary drilling method, or a downhole mud motor, or, preferably, the coiled tubing jet-drilling technology of U.S. Pat. No. 5,402,855, as part of the Combined Apparatus described above, in which the coiled tubing string is a, low-weight, spoolable, umbilical tubing.

The advantages presented by such a Combined Apparatus are:

- the Assembly housing, in one or, preferably, two pieces, is included in said Combined Apparatus. It contributes to safely guiding small-diameter drilling tools and the liner string into the branch borehole, as well as conveying drilling or completion fluids, through the bonded casing-liner stub connection;
- with the Assembly housing, reverse mud circulation from the annulus between casing and work string to the annulus between work string and umbilical tubing may be combined with a direct circulation from the umbilical tubing to the annulus between work string and umbilical tubing, resulting in improved cleaning of borehole, increased rate of penetration and easier insertion of the liner;
- after reaching the targeted depth of the branch hole, the umbilical tubing is pulled-out, leaving in the Assembly only the liner string, made of a single 3.5" OD coiled liner segment, preferably slotted in its lower part and hung in the welded and cemented liner stub;
- Gravel packing of the annulus in the reservoir portion of the borehole, if required, and cementation of the liner in the upper part of the borehole, may proceed, through the Assembly and the work string; the liner packer is set in the liner stub;
- the remainder of the Assembly housing may then be retrieved or drilled-out to restore access to the bottom part of the original casing.

The tubings completion of the dual well can then proceed, by conventional means.

Typically, a slick 2 ⅜" OD threaded tubing or, preferably, a 2.25" OD coiled tubing may be installed in the 4" ID liner of the branch well. A parallel 2 ⅜" OD tubing may be used in the original well, if the casing is 7" OD or greater. A downhole pump and auxiliary flow control devices may also be included in the tubing completion of the dual well.

It is clear that the pre-fabricated liner stub Assembly and the Combined Apparatus, including a jet-drilling nozzle fed by a spoolable umbilical tubing, both contribute to reducing the number of trips and, correspondingly, the rig labor required for the complete work-over conversion of the existing well into a dual well, thus reducing its total Capital Cost.

The facts that access of logging and cleaning tools to the bottom of the casing is preserved and that totally independent operation of the two wells is possible, while sharing some of the original production equipment (casing, downhole pump, pumping unit, oil/water separator, gas handling piping, oil storage and water disposal system) at a single well site, all contribute to a reduction of the Operating and Maintenance Cost of the dual well, on a per-barrel basis, as compared with that of several, geographically-separated, conventional single wells, capable of a comparable cumulative production.

Because of these large savings, the preferred mode of a Branch Well Additionn to an existing cased well is to combine the use of anyone of the Assemblies disclosed in first three Embodiments, with the Combined Apparatus disclosed in the Fourth Embodiment.

BRIEF DESCRIPTION OF THE DRAWINGS (FIGS. 1 to 15 refer to the First Embodiment of the Invention, while FIGS. 16 to 20 refer to the Second Embodiment; FIG. 14 refers to both:

FIGS. 21 to 21BB refer to the Third Embodiment;

FIGS. 22 to 22C refer to the Fourth Embodiment).

FIG. 1 is a vertical cross section (not to scale), in the vertical Plane of Symmetry AA, of the preferred First Embodiment of the Liner Stub Assembly, showing only three of the tubes of the dual cage of the stub-guiding system.

FIG. 1*a* is a transverse cross section of the slanted main cavity in the housing of said liner stub Assembly in Plane BB, perpendicular to the inclined axis of said main cavity, showing only four of the tubes of the dual cage stub-guiding system.

Figure 15:
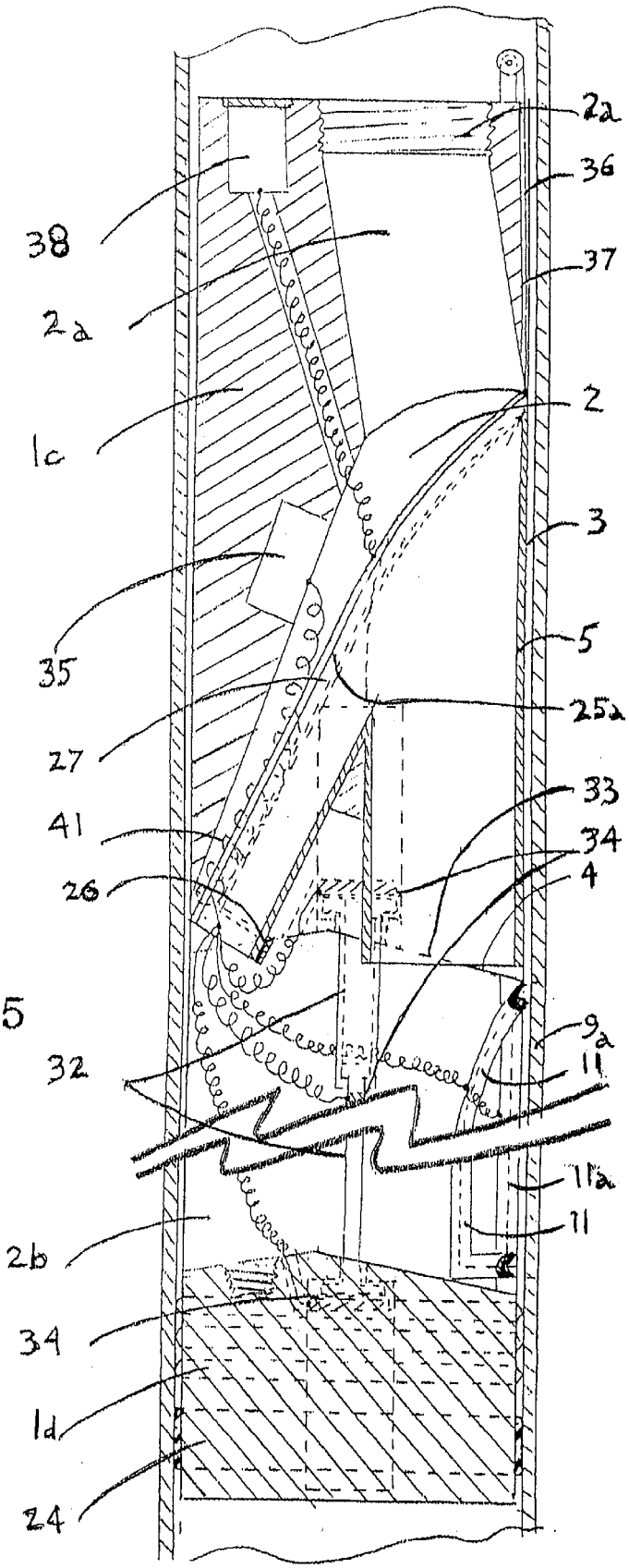

FIG. 15 is a vertical cross section in Plane AA of the Second Embodiment of the Invention, showing a prefabricated Assembly including a liner stub, presenting a square cut lower end and a bent elliptical upper end, equipped with a stop collar. Said collar's width is constant along the top half of its bent elliptical edge, but gradually increases along the bottom half of said elliptical edge, so as to form a short bent apron along the bottom half of said elliptical edge. The bent surface of the collar-apron piece is a portion of a cylindrical shell of outside diameter sligtly less than the inside diameter of the casing. Secondary explosive charges are affixed to the inner surface of said collar-apron piece, along its outer edge, within a sealed drillable pressure-resistant protector ring of "U"-shaped cross section. The liner stub is hung by a spring-loaded flexible coiled metal strap, held in a vertical groove of the housing.

Figure 16:
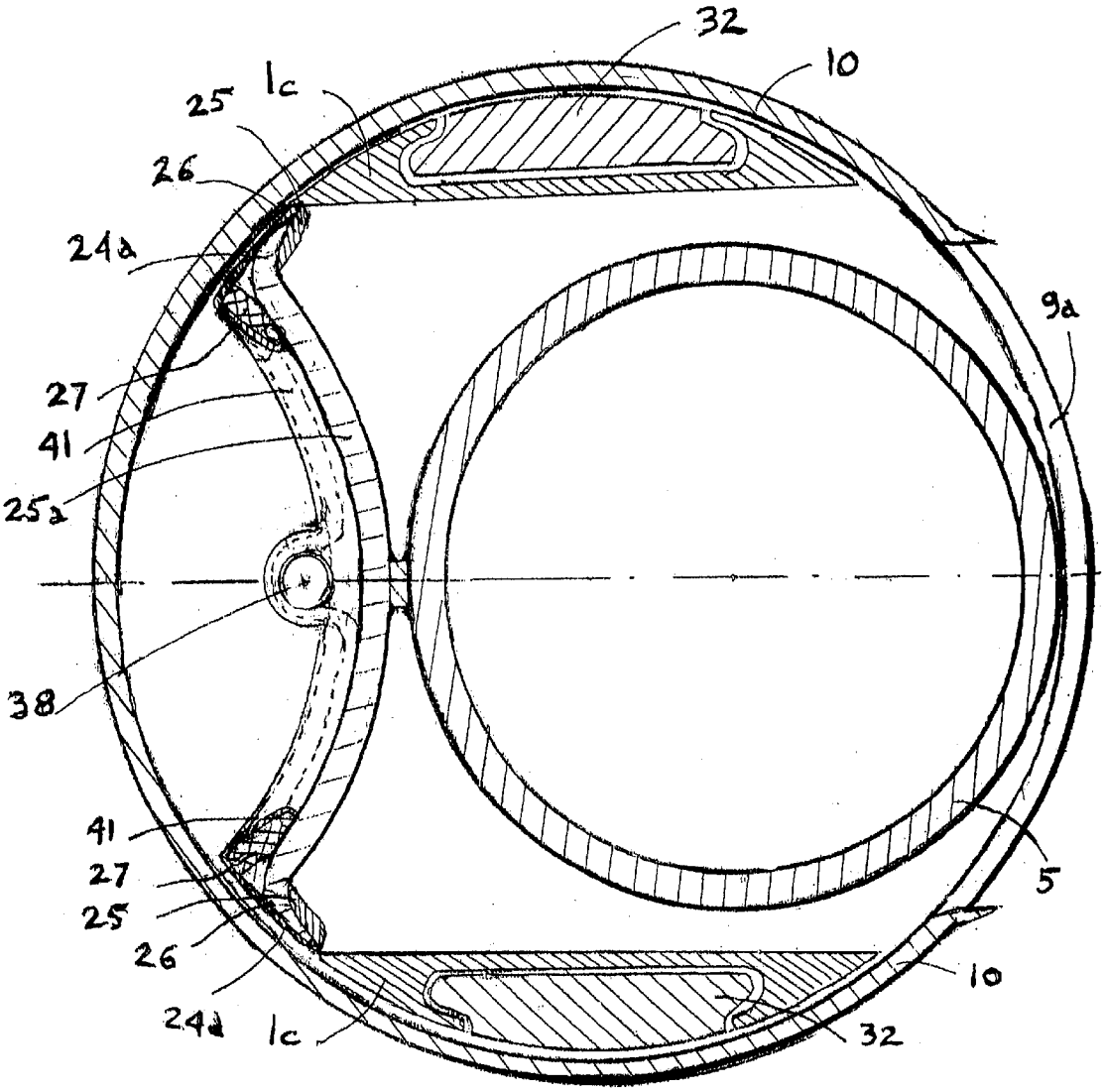

FIG. 16 is a horizontal cross section (to full scale) in the lower part of the stub Assembly in the Second Embodiment, in a 7" OD cased well, for a 4.5" OD liner stub to be kicked-off at an angle of 0.5 degrees from the casing axis.

Figure 16A:
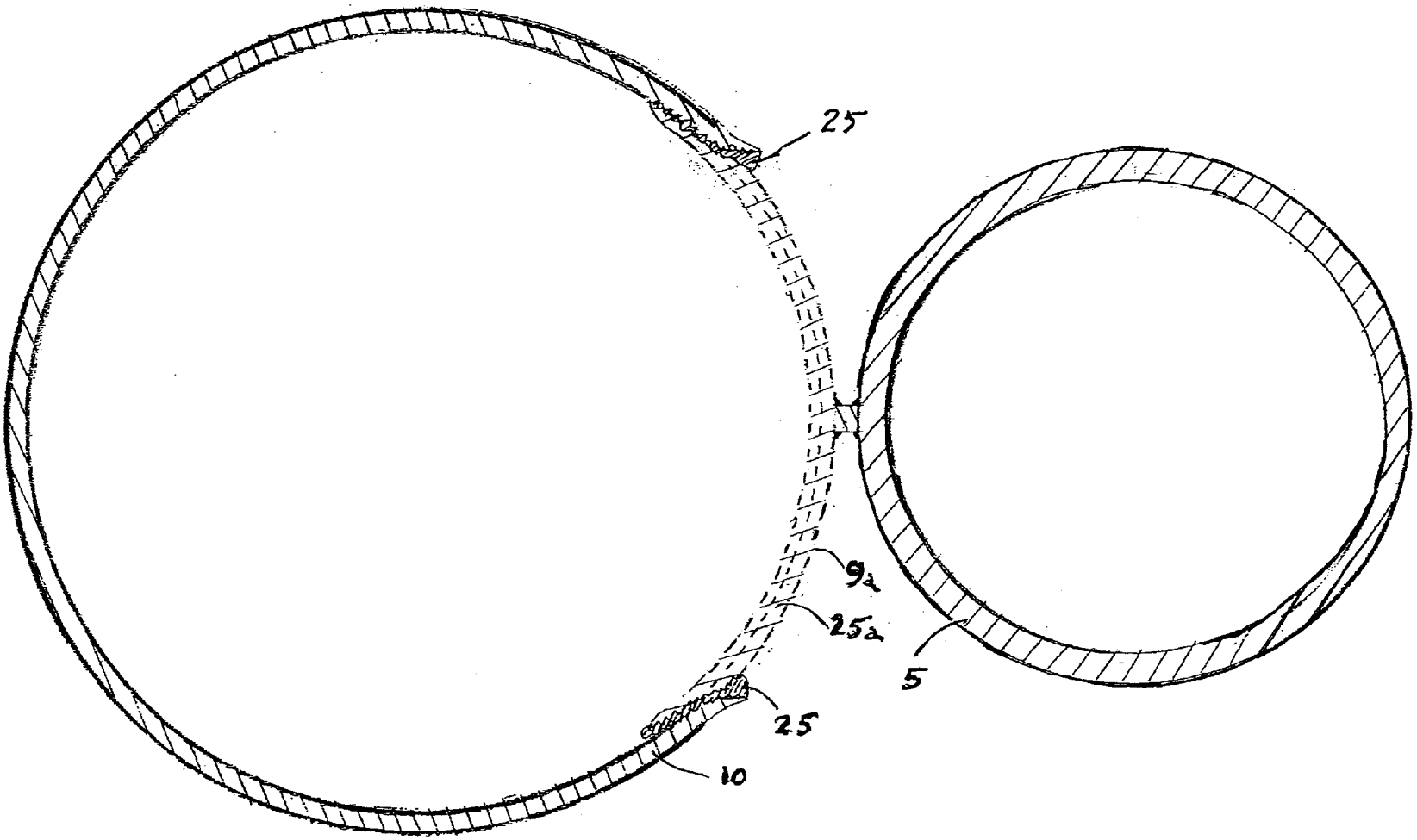

FIG. 16*a* is a horizontal cross section of the explosively bonded collar-apron, after the liner stub of FIG. 16 has been extended out through the casing window and cemented into the side-pocket hole.

Figure 17:
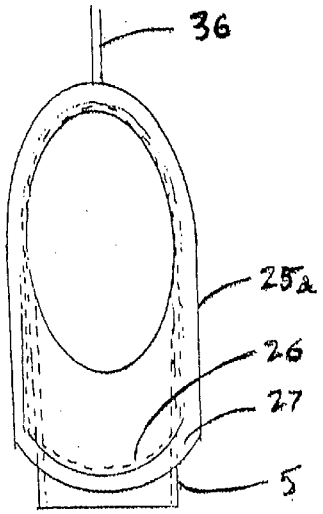

FIG. 17 is a perspective drawing of the liner stub, equipped with its collar-apron.

Figure 18:
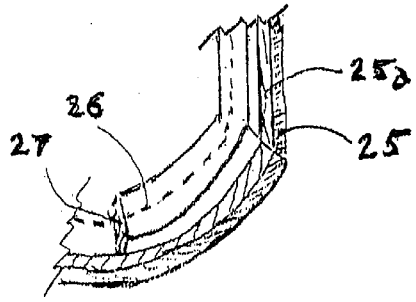

FIG. 18 is a perspective detailed drawing of the right lower corner of the apron part of the collar-apron, showing the secondary explosives.

Figure 19:
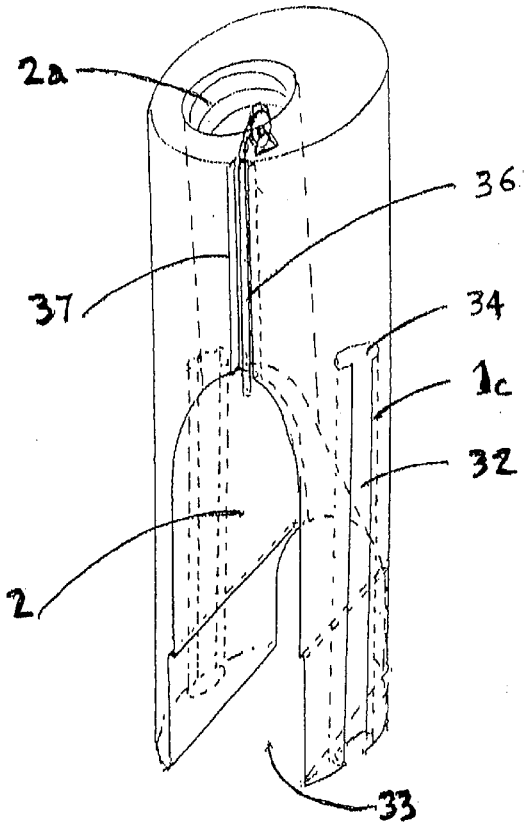

FIG. 19 is a perspective drawing of the cavity in the top piece of the Assembly housing, showing the liner's strap suspension system in the Second Embodiment.

Figure 20:
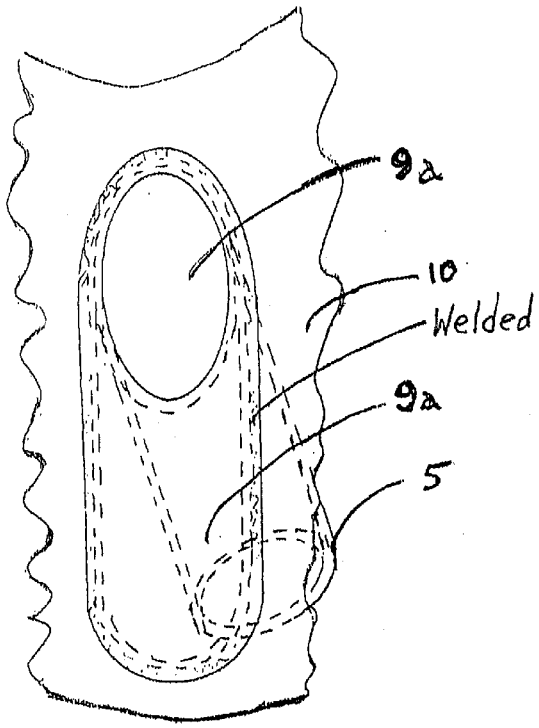

FIG. 20 is a perspective sketch of the casing window, showing the stub's collar-apron, explosively welded to the casing, obtained using the liner stub Assembly, in the Second Embodiment.

Figure 21:
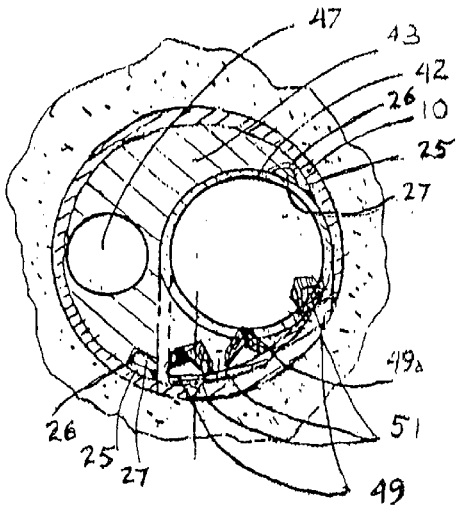

FIG. 21 is a vertical cross section of a simplified branch hole connector consisting of a pre-curved liner Assembly, compatible with a small-diameter by-pass tubing, for addition to the inner surface of an existing cemented casing, as the Third Embodiment of the Invention, wherein the window-cutting and explosive-bonding of the curved liner and of its re-inforcing collar to the window's edge are done simultaneously, by suitable charges.

FIG. 21AA is a transverse sectional view of the pre-curved liner Assembly, taken in horizontal plane AA.

Figure 21B:
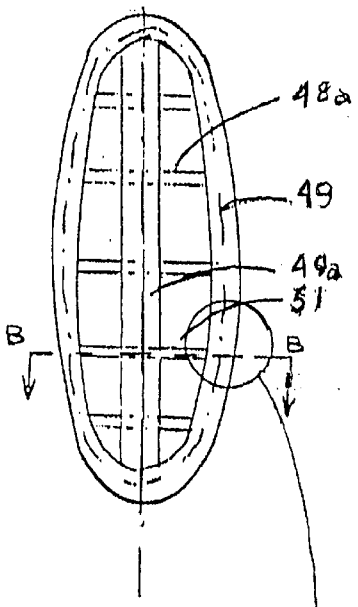
Figure 21:
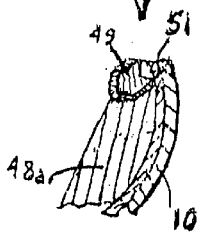
Figure 21:
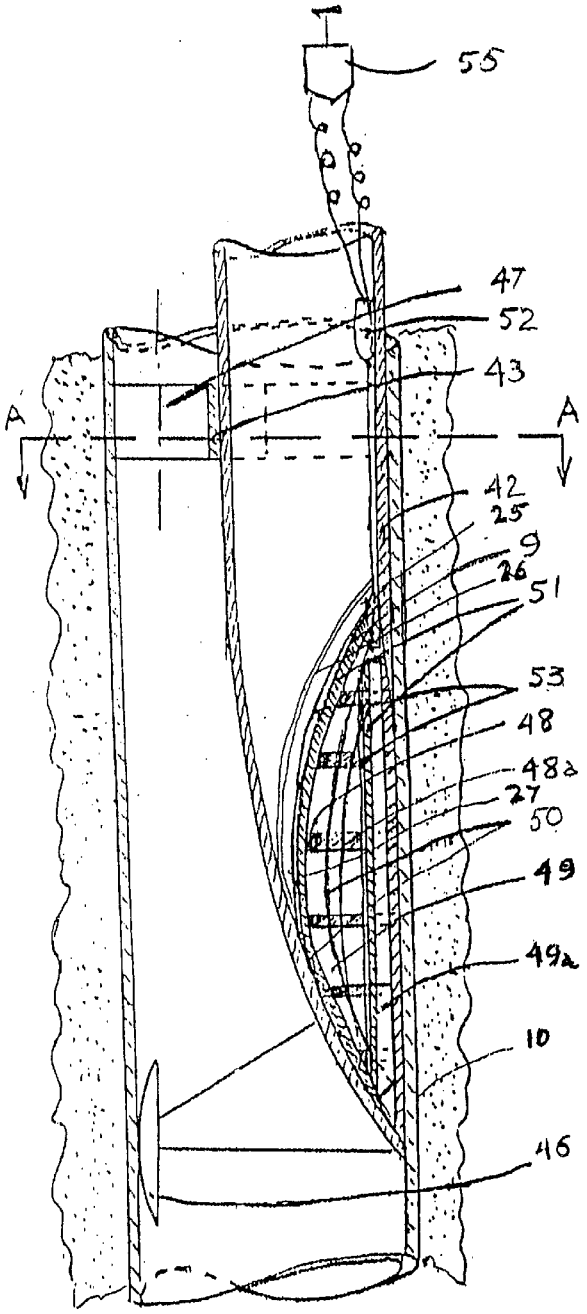

FIG. 21B is the back view of the ribbed cover plate closing the lower end of the pre-curved liner.

Figure 22:
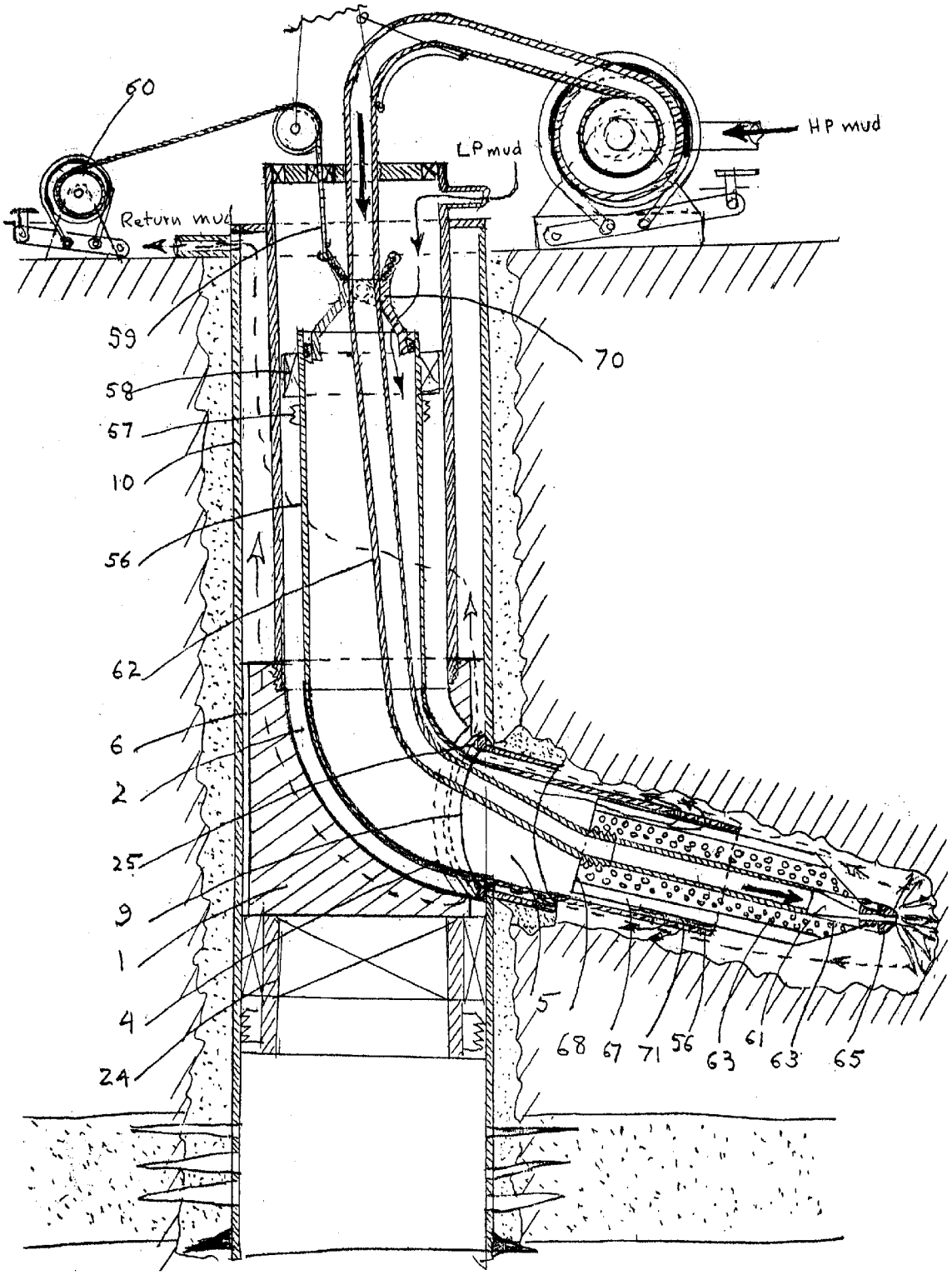

FIG. 21BB is a sectional view of the edge of the cover plate, taken through Plane BB, showing the right side of the shaped charge ring and the tie rib affixed to the cover plate FIG. 22 is a schematic vertical cross section of a Combined Apparatus for jet-drilling of a branch hole and installation of an un-coiled liner segment in said branch hole, including tool guides provided by the Assembly housing and by the welded and cemented stub.

FIG. 22A is a vertical cross section in Plane A'A', showing the liner segment upper part equipped with a packer-hanger and with a spring-loaded suspension Device releasable with a "go-devil"run along the suspension cable.

FIG. 22AA is a transverse cross section in Plane B'B', showing the two articulated semi-circular supports of the dogs of the suspension Device pressed into the inner surface of the liner to temporarily affix it to the suspension cable.

Figure 22B:
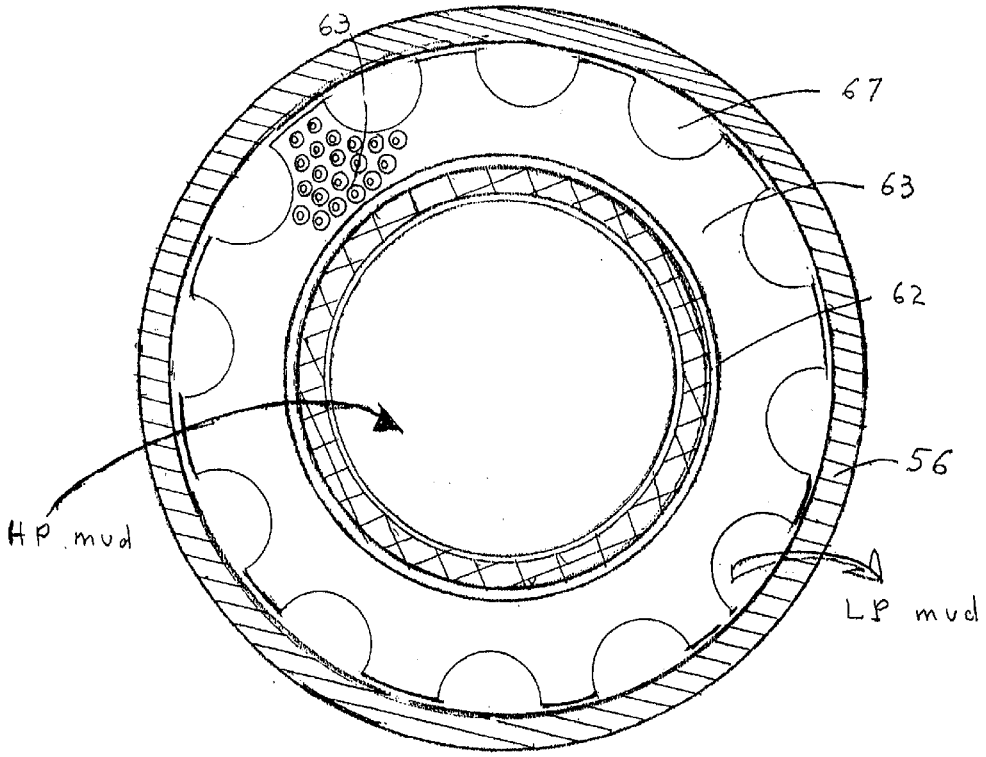

FIG. 22B is a transverse cross section of the lower part of the buoyant spoolable tubing feeding the jet nozzle.

Figure 22C:
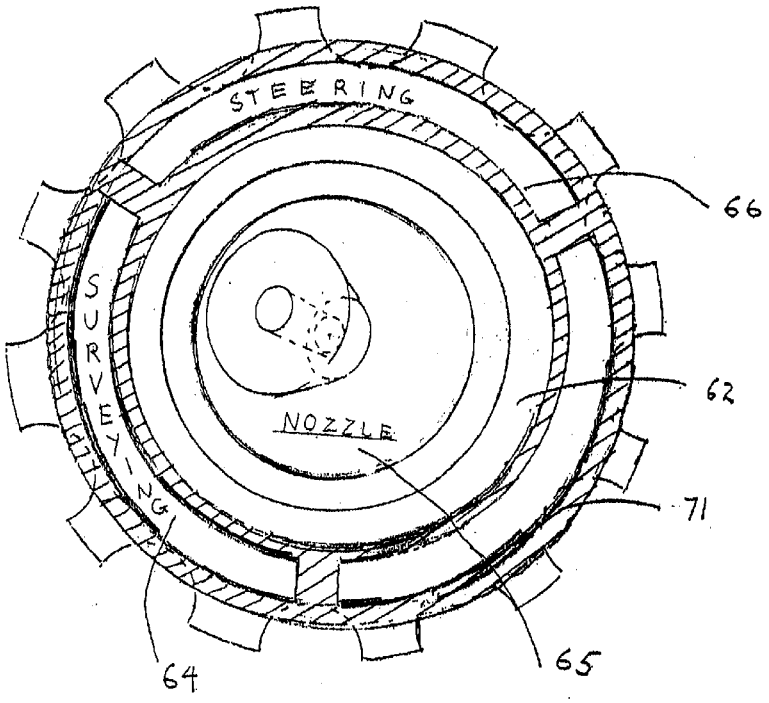

FIG. 22C is a block diagram of the nozzle steering and surveying modules in the lower part of the buoyant spoolable tubing.

DETAILED DESCRIPTION OF THE FIRST EMBODIMENT

FIG. 1 shows the finished pre-fabricated liner stub assembly prior to its coupling to the end of the work string. It consists of a drillable cylindrical housing (1), preferably in two wedge pieces (1*a*) and (1*b*), fastened together along their wedge plane, and presenting a main cylindrical cavity (2), at a very small angle (typically 0.7 degrees) from the vertical axis of said housing. Consequently, the cavity ends in two identical elongated windows (3) and (4). This is the preferred embodiment of a stub housing.

It will be apparent that the kick-off angle is determined by its upper limit, controlled by the minimum length of fully tubular liner stub, required for setting a short hanger-packer, while the lower limit of the kick-off angle is determined by the maximum total length of the Assembly, which can be handled by a conventional drilling rig derrick, for given values of casing ID and of liner stub OD.

Typically, the outside diameter of the housing (1) is equal to the drift diameter of the well casing in which it is to be run-in, for instance 6.33" for a 7" )D casing of 20 #/ft.

The ID of the cylindrical cavity (2) is slightly larger than the OD of liner stub (5), which, in the present example is 4.5" (4.0" ID).

The stub is machined using the method and tools of co-pending U.S. Pat. No. 6,065,209, as part of the pre-fabrication of the Assembly elements. The machined upper end of stub (5) is annealed by suitable application of heat, so as to increase the ductility of the steel at that upper end.

The housing window (3) is sealed from the casing fluid by a drillable elliptical cover plate (19*a*), fastened to housing (1). It is opened to any fluids in the work string, through the top cavity (2*a*), equipped with sealing threads matching those of the work string, but also remains sealed from the lower part of the inner space of the stub (5) by a circular upper cover plate (18), set in a piston-like sealing ring (22) of the inner cage (8).

Window (4) of the housing is also sealed, respectively by liner stub's elliptical cover plate (19) and by the elliptical ring cover (20), so that, when the Assembly is run in a liquid-filled casing, at the end of an air-filled work string, the lower end of cavity (2) remains air-filled, regardless of the nature of fluids contained in the work string.

A retrievable short hanger-packer (24) is located in the bottom part of the Assembly, providing means for temporarily isolating the bottom part of the existing well below the kick-off point of the future branch well, during its installation.

The liner stub (5) is held within dual guiding cages (7) and (8), made of linked drillable tubes. The tubes of cage (7) glide inside square grooves (6) of the housing (1). The various functions of these and of other internals within cavity (2) are explained below.

FIG. 1*a* shows the transverse cross section of cavity (2) in Plane BB, closed respectively by drillable cover plates (19*a*) and (19) at its top and bottom.

It presents a plurality of grooves (6), of non-circular section, parallel to the cavity's axis. Each groove contains a short tubular bar of the outer guiding cage (7). The lower end of those prismatic tubes is bent inward and remains in sliding friction contact with the outer surface of stub (5), prior to reaching their stopping point against the inner surface of the casing, when stub (5) is about half way through the windowed portion (9) of casing (10).

The cylindrical tubular bars (16) of the inner guiding cage (8), are made of several longer co-axial pieces, locked to stub (5) during the displacement of the outer cage (7), which become un-locked when outer cage (7) reaches its stopping point. Tubular bars (16) of the inner cage (8) are structurally linked by several transverse rings of circular or elliptical shapes. After being un-locked, the lower end of each tube (16) telescopically extends outwards, away from its now stationary upper end, connected to the upper end of the stopped tube of outer cage (7), thus further pushing stub (5), to which it is affixed by breakable fasteners (13). The bottom end of each tube (16) is equipped with a fixed jet-drilling nozzle (14). A helicoidal vane (15) rotates the casing fluid flowing through the lower telescopic tube (16) of inner cage (8). The connection between the upper end of each prismatic tube of outer cage (7) with the upper end of the corresponding tubular bar (16) of inner cage (8) is by means of a "U" shaped flow connector (17), initially located radially across the edge of the upper housing window (3). When fully retracted in stub (5), inner cage (8) also acts as a bracing support of the two ribbed cover plates (18) and (19), respectively closing the central part of stub (5) and the upper end of liner stub (5).

A sealing cover ring of drillable material (20), equipped with elastomeric seals, also encloses the housing's elliptical groove (12) to prevent contact of the casing fluid with the elliptical explosive cordon (11) and with its associated detonating and firing system, prior to their explosion.

The parallel tubes (16) of the inner cage (8) are held together by a tubular elliptical ring (21) near the end point of each fully extended tube of inner cage (8). The outside diameter of ring (21) is smaller than the drift diameter of liner stub (5). Conversely, the middle part of each of the telescopic tubes (16) of inner cage (8) is connected by a sealing circular support ring (22), thus providing sufficient structural strength against buckling of the inner cage (8), and holding the wireline-retrievable ribbed cover plate (18), sealed within its center hole. Cage (8)'s lower part is under compressive forces, applied respectively by the drillable cover plates (18) and (19), under the differential pressure between the work string fluid and the casing fluid, during run-in and setting of the Assembly.

The upper telescopic tubes of inner cage (8) are also affixed to a similar support ring, of elliptical shape, at their upper end, adjacent to the connecting tubes (17), giving additional structural strength to cage (8).

Plate (19), sealing the lower end of liner stub (5), is equipped on its inner face with a plurality of straight explosive cutting cordons **(11*a*), similar to the curved cordon elements making up the elliptical cordon (11). The parallel cordons (11*a*) are vertical. They are detonated a short time after the complete detonation of elliptical cordon (11). Their primary function is to cut through the cover plate (19), through the casing wall (10) and to divide both plate (19) and the remnant of casing (10) within elliptical window (9), cut by cordon (11), into narrow metal strips removable via liner stub (5). A secondary function of cordons (11*a*) is to make deep vertical cuts into the formation, within window (9), to facilitate the initiation of a side pocket, by jet-drilling, subsequent to the firing of cordons (11) and (11*a*). For this reason, plasma jets formed in the explosion of the straight cordons are aimed into radial planes of the casing wall. This is in contrast with those from elliptical cordon (11), in groove (12) of the Assembly housing (1), which are aimed obliquely toward the axis of the cavity (2), because the only function of cordons (11) is to make a neat window cut-out of the casing just outside of the liner stub's lower end, co-axial with cavity (2)**.

The liner stub (5) is a straight mechanical tube, made of high strength steel accurately machined at both ends, to conform with the shape (a bent ellipse) of the desired window to be cut in the casing. The edge of the stub's upper end is equipped, on the outside, with a thin stop-collar of softer metal (25) of constant width. On the inside, the drift diameter of stub (5) is reduced by a matching drillable protector ring (26) of "U"-shape cross section. Elliptical ring (26) is filled with secondary explosive (27) and with the associated detonator and firing system (41) required to initiate the explosion, from the bottom edge of the explosive ring, inside ring (26). The object of said secondary explosion is to create a solid, leak-proof,bond between the respective edges of the casing window cut-out (9) and of the liner stub (5) with said liner stub's stop-collar (25), made of softer material.

Prior to the extension and bonding of liner stub (5), however, four successive operations are performed downhole, within the Assembly:

A) a window (9) is cut-out in the well casing by firing explosive curved cordons (11), located in an elliptical groove (12), around the lower window (4) of housing (1); this operation also opens groove (12) to flow communication with the annulus between casing (10) and housing (1), so that casing fluid flows into the tubular bars of the outer guiding cage (7) and, from there into the telescopic tubes of the inner cage (8);

B) straight explosive cordons **(11*a*), fired shortly after cordons (11) cut into narrow strips all materials located within window (9)**;

C) all explosion debris and all strips of casing wall remnants from within window (9) are removed by wireline tools and brought to the suface via the housing cavity (2) and through the work pipe string;

D) a jet-drilling operation is initiated, to drill, through window (9), a side pocket hole in the adjacent formation, of dimensions sufficient to contain the entire stub (5), in its fully extended and guided position. This last operation is described below:

The firing of all cutting cordons un-seals plate (18), which is then retrieved by wireline, to provide a larger return flow path to the surface, and to allow the removal, by wireline or coiled tubing tools, of all metal and cement debris from window (9) and from liner stub (5).

A retrievable hanger-packer (24), located below the lower window (4) of housing (1), prevents any flow of the casing fluid, from the surface pump, to the space below the Assembly housing (1). Packer (24), supporting the housing (1), is preferably made of drillable materials, in the event of a failure of its retrievable system. Outer grooves (23), cut in the lateral surface of housing (1) bring fluid from the casing-work string annulus to elliptical groove (12) of said housing, now open into the casing and, from there, to the lower end of each tubular bar of the outer cage (7), after the explosions of cordons (11) and **(11*a*). This casing fluid is then conveyed, through outer cage (7) to the connecting tubes (17) and into the telescopic tubes of the inner cage (8)**.

The fluid is forced to rotate around a helicoidal vane (15) before it reaches each nozzle (14), to form a high-velocity fixed jet, rotating around its axis.

This jet's liquid is capable of drilling through soft rock formations, before returning to the surface through the liner stub and the work string, carrying the formation cuttings eroded away by the multiple fixed jets. This flow constitutes what Drillers call a high-velocity "reverse" mud circulation, commonly used for hole cleaning operations. To facilitate the entrainment of cuttings by the return stream to the surface, via the work string, the fluid column may be lightened by the introduction of compressed air or gas into the return stream, thus increasing the differential pressure across the jet nozzle and the flow velocity of the return stream in the work string.

A smaller by-pass stream of casing fluid also leaks from groove (12) over the outer surface of housing (1) and, washing over that of liner stub (5), penetrates into the lower end of stub (5) to reach the cavity (2) in housing (1). From there, it flows into the work string to the surface. It contributes to the erosion of the formation in contact with the lower end of stub (5) during the stub's guided penetration, by gravity, into the steadily deepening side pocket hole, until the stop collar (25), affixed to the upper end, rests against the inner surface of the casing. The "reverse" mud circulation is then stopped and replaced by a "direct" mud circulation, in which the differential pressure across collar (25) firmly applies it against the inner surface of casing (10).

The secondary charges (27) are then fired to explosively bond the annealed upper end of liner stub (5) and its collar (25) to the casing around window (9), thus forming a sealed connection.

Functions of the Assembly Disclosed in FIG. 1 and FIG. 1*a*

The Assembly and its various on-board elements and tools provide the following functions, when it has been run-in, oriented in the casing (10) and sealed-off from the bottom part of the casing by the hanger-packer (24):

1) to accurately position the liner stub (5) opposite its future entry area into the formation, materialized by window (4) of housing (1), and to provide air-filled enclosures for all explosives,
2) to cut-out, by means of explosive cordons (11), a window (9) in the casing, destroying in the process the protective cover ring (20) and making an elliptical cut into the cement and formation around window (9),
3) to cut into narrow strips the portion of casing (10) enclosed by window (9) and also to cut the cover-plate (19), by means of straight explosive cordons (11*a*), thereby also making cuts along vertical radial planes into the formation,
4) to guide wireline tools into liner stub (5) for the removal of debris from the explosions, including said narrow strips,
5) to jet-drill a side pocket hole through window (9), while guiding the progression of liner stub (5) into said side pocket hole, by means of the tubular dual cages (7) and (8) and of their jet nozzles (14),
6) to guide stub (5) in a spin-free translation and to hydraulically apply its stop collar (25) against the inner surface of the casing, around window (9),
7) to bond together the casing (10), the upper end of liner stub (5) and collar (25) by means of secondary explosives (25), so as to seal their connection around window (9), thereby breaking into small pieces the charges protective ring (26), made of drillable material.
8) to guide tools into the cavity (2) of housing (1) for the removal of the stub-guiding dual cages (7) and (8) and for the cementation of liner stub (5) in said side pocket hole,
9) to become part of the Combined Apparatus, used for drilling and completing the branch well, through the same work string and stub (5), and for setting a hanger-packer (58) of the branch well liner into liner stub (5), thus providing a sealed connection between the branch well liner and the liner stub (5), already sealed and cemented to casing (10).

Retrieval of said Combined Apparatus, including the Assembly's supporting hanger-packer (24), re-opens the original well, providing free access into both the original well and the branch well for their respective tubing completion, by known means.

Figure 2:
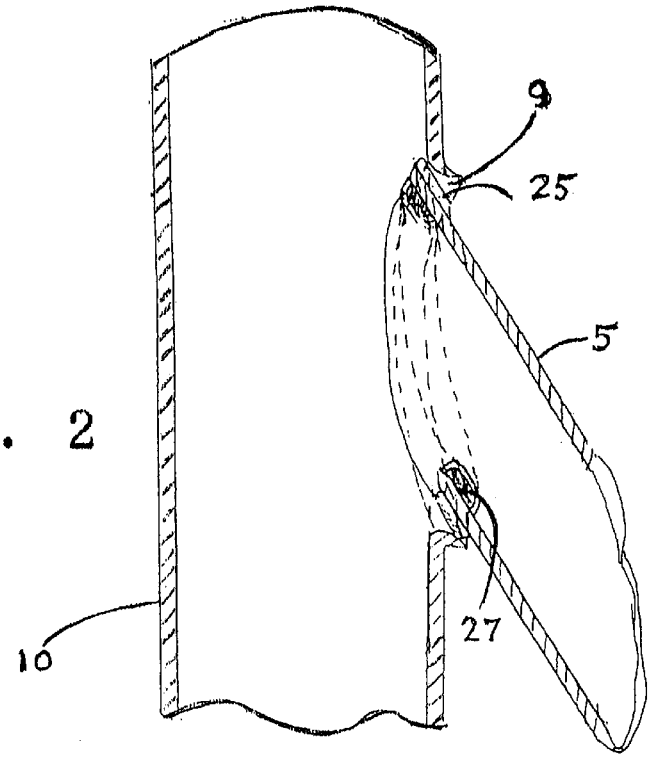
FIG. 2 is a detailed vertical cross section of the upper end of the liner stub wall, showing the stop collar and the disposition of the welding explosives in their drillable enclosure, within the the casing window, after full extension of the liner stub and prior to the explosive-welding operation.

Description of Additional FIGS. 2 to 14, Which Relate to the Preferred First Embodiment FIG. 2 shows in detail the relative configuration of stub (5) and of window (9), together with the stop-collar (25) around the annealed upper end of liner stub (5), just before surface-triggered secondary explosives (27) are detonated to form an explosively-bonded sealed junction between stub (5) and casing (10), around the window (9).

Figure 3:
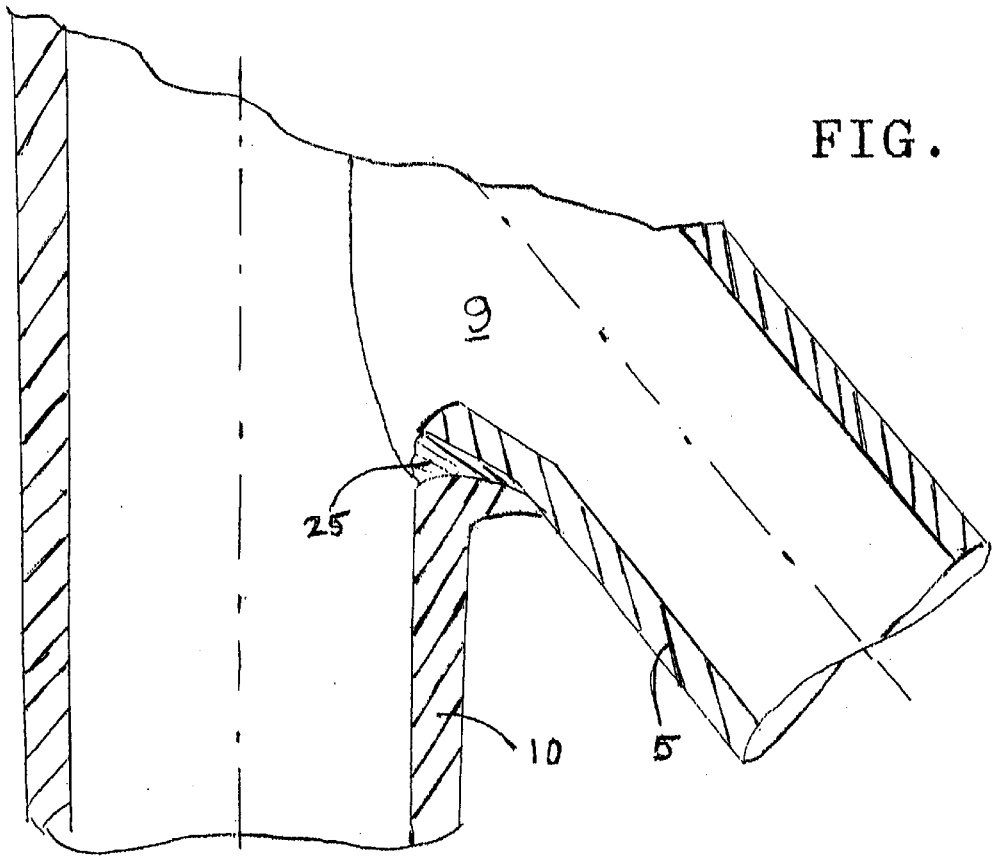
FIG. 3 is a detailed vertical cross section of the weld between liner stub wall and casing wall, at the lower end of the window's edge.

FIG. 3 shows a cross section of the weld obtained, between the upper end of liner stub (5) and casing (10) along the elliptical edge of casing window (9). It shows the slight enlargement of the upper end of the liner stub (5), as a result of the detonation of the secondary explosives (27) and the wavy interfaces between the softer metal of stop-collar (25) and the steel of liner stub (5) and casing (10), after explosive bonding.

Figure 4:
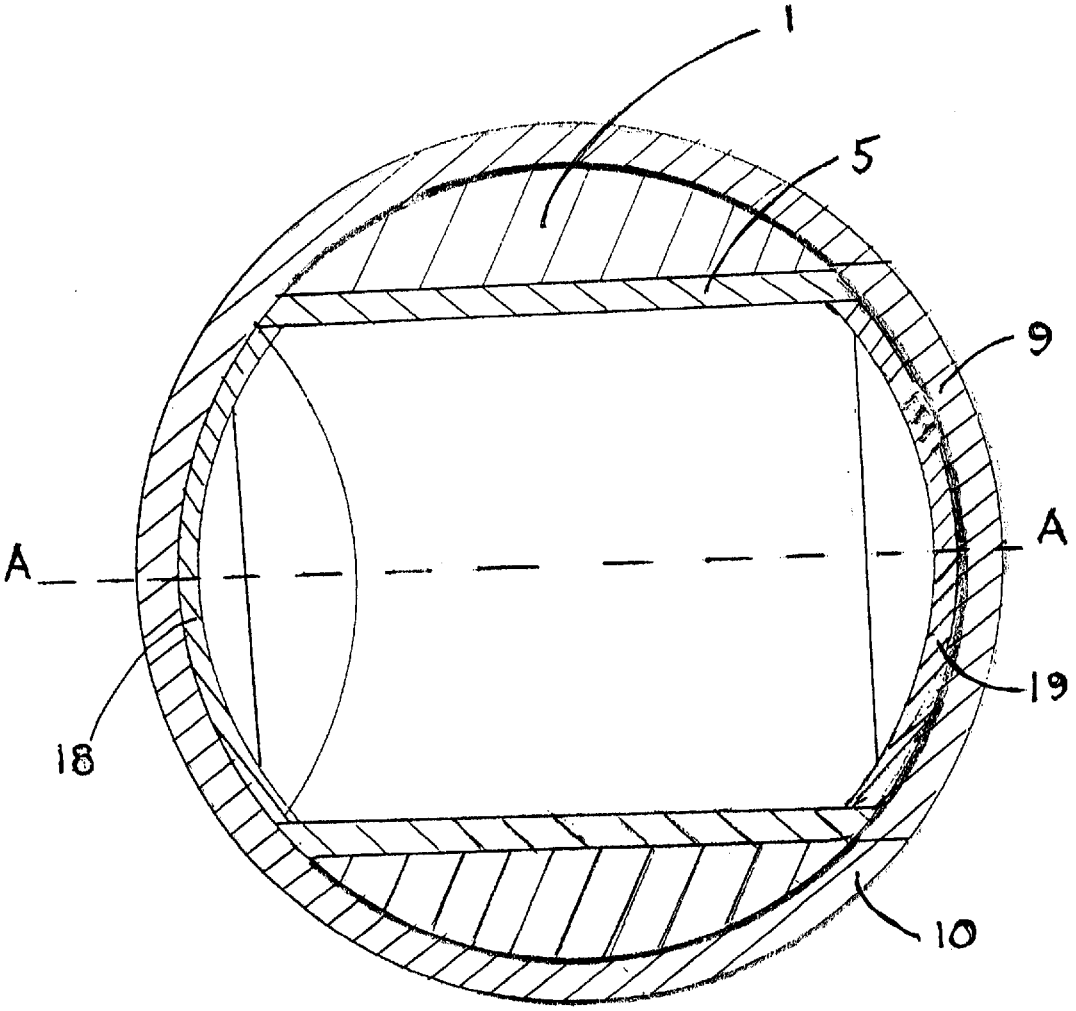
FIG. 4 is a horizontal cross section to scale (2 cm=1") of the liner stub assembly for a 7" OD casing and a 4.5" OD (4" ID) liner stub, on the left showing the stub's upper end in Plane CC and on the right showing the stub's lower end in Plane C'C'.

FIG. 4 is a horizontal cross section, to scale, of a 7" OD casing, with a housing assembly of 6.33" containing a liner stub of 4.5" OD and 4.0" ID. For a kick-off angle of 0.7 degrees, the length of the fully-circular part of the stub's inner surface is about 24", sufficient for a conventional short packer in a 3.5" OD liner string. The total length of the assembly is approximately 63 ft, suitable for handling in even the smallest derricks of the cheapest work-over rigs. If the kick-off angle is reduced to 0.5 degrees, a 34"-long packer may be used, instead, but the length of the whole assembly increases to 93 ft, requiring a taller derrick, capable of handling triple joints.

Figure 5:
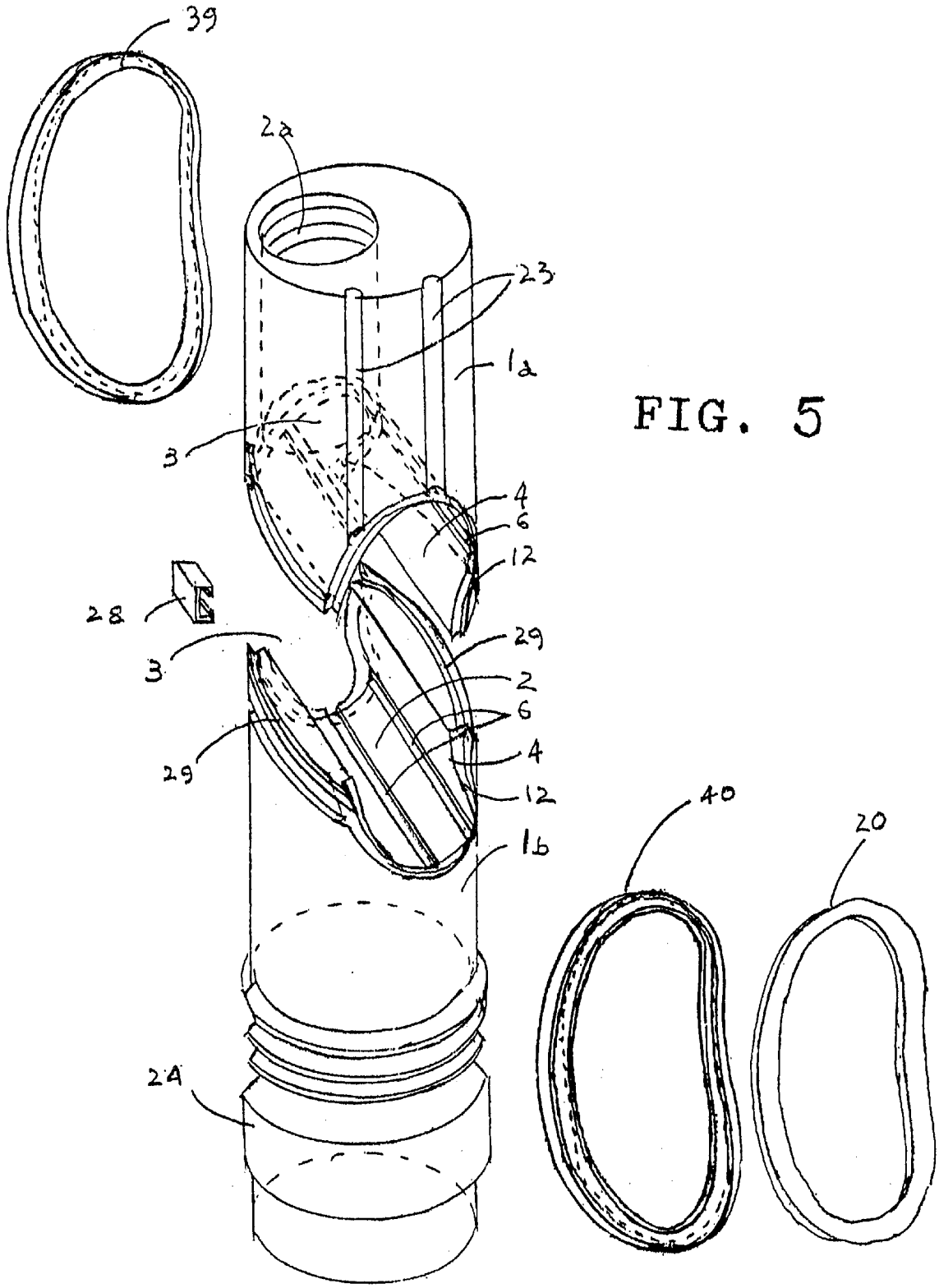
FIG. 5 is a perspective drawing showing an exploded view of a housing made of two superposed pieces assembled in the horizontal axial plane of said liner stub, perpendicular to Plane AA.

FIG. 5 is an exploded view of a housing (1) made up of two drillable pieces (1*a*) and (1*b*) wedged together and sealed in their inclined contact plane. The cavity (2) may then be opened-up by cutting the drillable fasteners (28) across the contact plane. Two elliptical compression rings (39) and (40), affixed respectively in matching grooves (12*a*) and (12) around the housing windows (3) and (4), are also made of drillable material. Their primary function, together with two "O" ring grooves (29) cut in the contact plane is to contribute to sealing the contact plane from the casing fluid. Ring (40) is hollowed-out to carry the curved cutting cordons (11) within the air-filled space sealed by the elliptical cover ring (20).

The feature of a housing (1) in two pieces allows to remove only the upper part of the housing, after bonding of the stub (5) to the casing window (9). The remaining lower part of the housing may then be used for guiding a small-diameter drill string and other tubulars during the deviated hole's completion. In such a case, the fasteners referred in FIG. 1 for affixing cover plate (19*a*) to the upper piece of housing (1*a*) are breakable, leaving cover plate (19*a*), not shown on FIG. 5, as casing protector against potential damage from bent drilling tools later inserted from the casing into the installed liner stub.

The two-piece design of FIG. 5 also allows to machine the housing from two shorter ingots of drillable metal, at a slightly lower cost. If, however, the housing is made of cast Aluminum, both halves of the housing may be made from the same mold, at a larger cost saving.

Its main advantage, however, remains that it provides the optional possibility of separately removing the upper part of said housing. This allows an easier access, if necessary, during the drilling and completion of the branch well through the bonded and cemented stub, to conventional drilling and completion tools. These are less flexible and heavier, but more costly, than those included in the preferred Fourth Embodiment of the Invention.

It will be apparent to those skilled in the Art that housings (1) made from a single piece of drillable material, as shown on FIG. 1, perform all the same primary functions as the two-piece housing, shown on FIG. 5, without departing from the present Invention, but at a slightly higher cost of the Assembly and at a significantly reduced flexibility of drilling and completion operations.

When other drilling tools, of larger diameter than a steerable jet-drilling system fed by a buoyant spoolable umbilical have to be used, because of the characteristics of the underground formations, the advantage of an Assembly housing in two parts, (1*a*) and (1*b*), allows part (1*a*) to be removed first, together with the work string, so that conventional drilling and completion tools, may be guided directly from the casing, by the remaining part of the housing (1*b*), through the liner stub (5).

The option, however, of using conventional tools, is at the extra cost of one trip, for the removal of the previous work string and its replacement by a conventional drill string.

It will be shown later how this additional expenditure is totally eliminated by the Apparatus disclosed as the Fourth Embodiment of the Invention. Nevertheless, the small additional cost of an Assembly housing made in two pieces, but used in conjunction with the Fourth Embodiment of the Invention, is fully justified for providing a cheap insurance that conventional heavy drilling tools, requiring the full casing space may at any time be brought in and temporarily substituted to the jet-drilling Combined Apparatus, disclosed herein, if some of the formations to be drilled-through turn out to be harder than expected.

Figures 6, 7, 8:
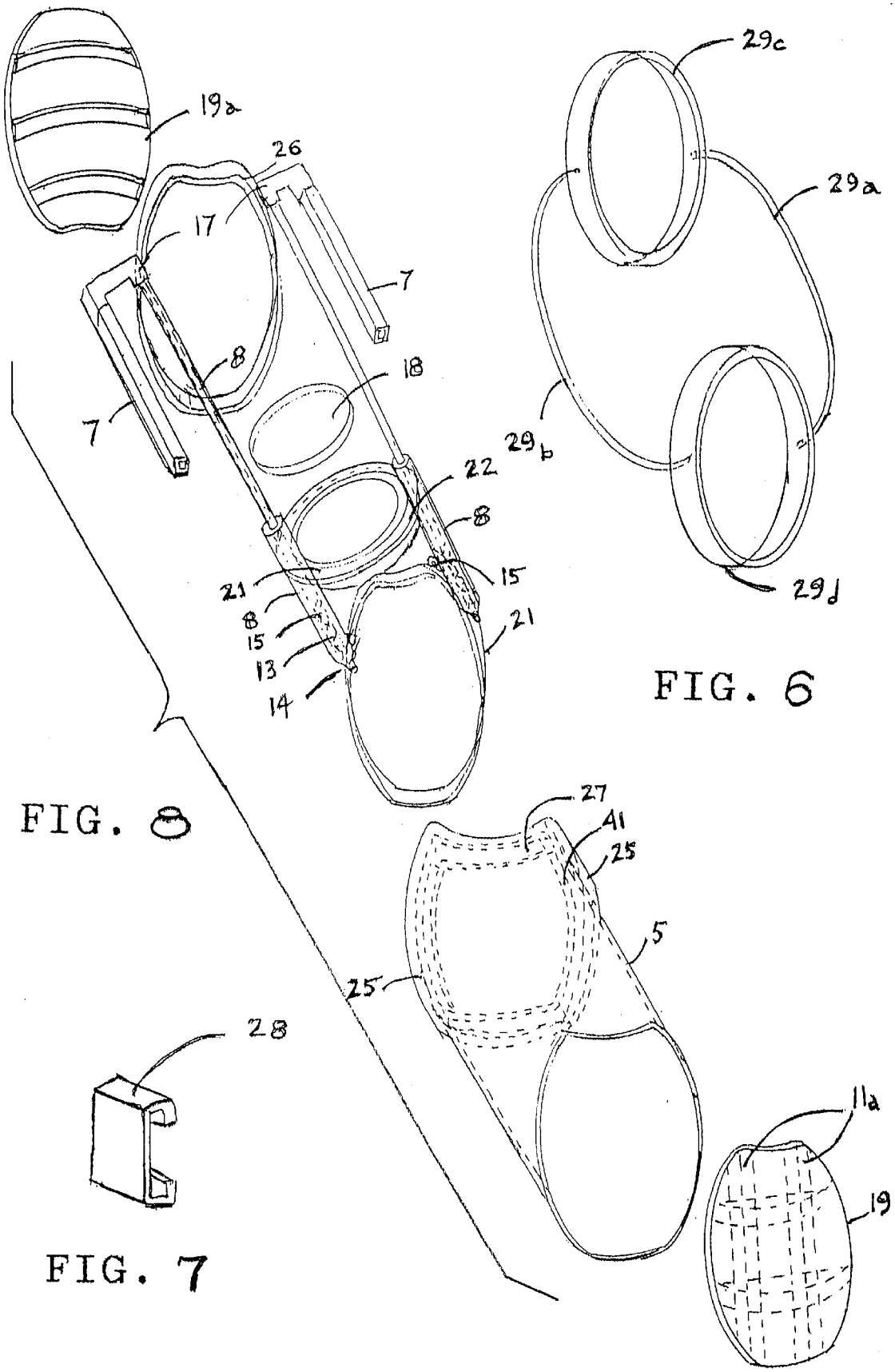
FIG. 6 is a perspective sketch of the composite elastomeric pressure seal joint between the upper and lower pieces of said housing.
FIG. 7 is a sketch of the drillable fasteners attached to both pieces of said housing.
FIG. 8 is an exploded view of the upper cover plate, housing, dual guiding cage, liner stub equipped with its stop collar and of its bottom drillable cover plate.

FIG. 6 is an exploded view of the composite elastomeric "O" ring seal used in grooves (29) of a housing assembly made of two pieces wedged together.

To prevent entry of casing fluids into the work string through the inclined plane of contact between housing pieces (1*a*) and (1*b*), the elastomeric seal comprises two cylindrical segments (29*a*) and (29*b*) of seal material, placed in two lateral grooves (29) machined in the slanted plane surface of one of the two housing pieces (1*a*) or (1*b*) and cemented at each of their upper and lower ends to the flat surface of a ring joint, (29*c*) and (29*d*m), of the same seal material.

Each of the two flat sealing rings (29*c*) and (29*d*) is compressed between the flat outer surface of respectively a machined elliptical ring of drillable material, (39) and (40), of constant width, and the inner surface of groove (12) cut into housing pieces (1*a*) and (1*b*) to a constant depth around the elliptical windows (3) and (4).

The bent elliptical ring of drillable material (40) compressing seal (29*d*) within groove (12) surrounding window (4) is hollowed-out to carry the curved cutting cordons (11). The outer face of ring (40), co-axial with the common cylindrical surface of (1*a*) and (1*b*) is sealed by the elliptical cover ring (20), so as to maintain an air-filled space around cordons (11), in the same way as when housing (1) is made of a solid single piece of drillable material. Rings (39) and (40) are each equipped with an "O"ring seal on their inner surface, which is in contact with the outer surface of liner stub (5), prior to the firing of cutting cordons (11).

FIG. 7 is a sketch of a type of drillable fastener (28) used in a housing made of two wedged pieces, to affix said pieces together. It will be apparent to those skilled in the Art that many other types of fasteners, made of a variety of drillable materials, may also be used, without departing from the present Invention.

FIG. 8 is an exploded view of the upper cover plate (19*a*), with respect to the upper end of the dual cage stub-guiding system, which is also used to jet-drill the side-pocket hole. It shows the dual cages (7) and (8), with their radial connector tubes (17) and the upper end of liner stub (5), oriented so as to show outer stop-collar (25) and the inner secondary explosive ring (27), sealed within its protective drillable ring (26). The detonating primacords (41) are located at the base of explosive ring (27), so as to fire upwards, within the housing cavity (2), which, by then, is filled with casing fluid. Only two of the prismatic tubes of the outer cage (7), two of the "U"-shaped connector tubes (17) and two of the telescopic tubes of the inner cage (8) of the stub-guiding system are shown. The circular bracing ring (21) of the lower tubes of the inner cage (8) is shown with its "O" ring seal and with its sealing cover plate (18). Said lower tubes of the inner cage (8) are fastened to the inner surface of liner stub (5) by means of breakable fasteners (13), along another bracing ring (21), of elliptical shape, and preferably tubular. Jetting nozzles (14) and helical inserts (15), at the end of said lower tubes of the inner cage (8) are also shown. Finally, the elliptical lower cover plate (19), carrying two straight linear cutting cordons (11*a*) on its inner surface is shown.

Figure 9:
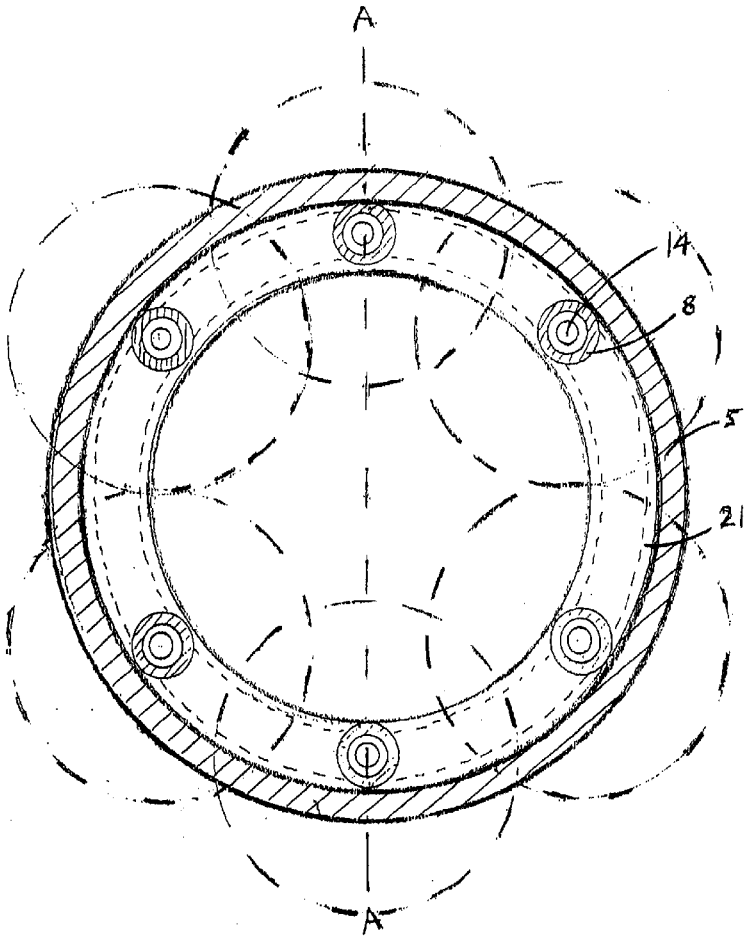
FIG. 9 is a transverse cross section in Plane DD of the lower part of the tubular guiding cage., showing the drillable fastener attaching it to the lower part of said liner stub.

FIG. 9 is a transverse cross section in Plane DD of the bottom end of the inner cage, showing the relative positions of ring (21) with respect to telescopic tubes (8) and the drilling radius of the jets from various nozzles (14), along the bottom edge of liner stub (5).

Figure 10:
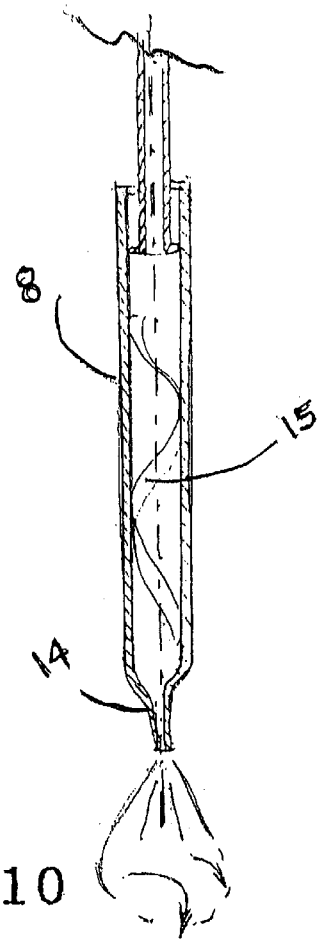
FIG. 10 is an axial cross section in Plane EE, perpendicular to AA of the lower part of said tubular guiding cage, showing the helical vane and bottom jet-drilling nozzle.

FIG. 10 is an axial cross section in Plane EE, perpendicular to DD, of the lower end of the inner guiding cage, showing lower tubes (8), helicoidal vane (15) and nozzle (14). Additional nozzles may be connected to the elliptical tubular ring (21), for drilling in harder formations within and around liner stub (5).

Figure 11:
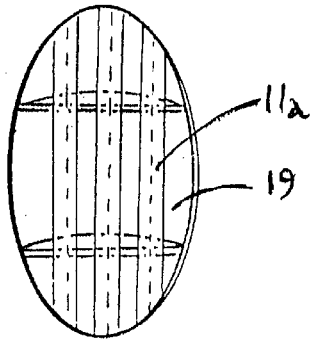
FIG. 11 is a view of the ribbed back face of the stub's lower end cover plate, showing the attached cutting cordons.

FIG. 11 is a view of the inner face of the cover plate (19) at the lower end of stub (5), showing the initial disposition of 3 cutting explosive cordons (11*a*) which, when detonated, divide the cover plate (19) and the remnant of casing (10) behind said cover plate (19), into 4 narrow strips, removable through the liner stub (5). Contrary to the elliptical cordon (11), located in housing groove (12), outside the stub, these straight cordons are aimed within the casing wall's radial planes. This maximizes the penetration of their cutting jets through plate (19), casing (10) and finally into the formation, within the elliptical window (8), previously cut by cordon (11).

All the known types of surface-triggered firing systems, fuzes, detonators, and the various modes of their actuation downhole, by mechanical, hydraulic or electrical means, for firing cordons (11) and (11*a*), at and near the lower end of liner stub (15), independently from those used to later fire the secondary explosives attached to the upper end of said stub, may be included in the assembly. The firing sequence, controlled by fuzes or other delaying devices, of various portions of cordons (11) and (11*a*) is selected so as to minimize unwanted deformations of the casing and stub as a function of the downhole environmental conditions of pressure, temperature and fluids composition, and of the Government-mandated safety procedures required for handling explosives on a drilling rig and in a well. Included in the firing system are means to separately disarm downhole the cutting cordons and the secondary explosives. For instance, this may be achieved by using, for the corresponding detonator or firing pin, only those types which are retrievable from the top of the assembly, by wireline tools run in the work string.

A preferred system for preventing the premature explosion of such explosives in wells includes an electrically-operated detonator and slapper tool, run in the work string at the end of an electric cable and mechanically coupled to a matching receptacle within the inner cage (8), to which are connected the starting ends of primacords and fuzes leading the detonation wave respectively to the explosive cutting cordons (11) and **(11*a*). This small-diameter wireline tool is inserted through cavities (2*a*) and (2) into the upper end of the locked liner stub (5) and landed on the upper surface of plate (18), which bears the sealed connector of the primacords and fuzes ends. From there, the electrically-triggered detonation wave proceeds in the primacords to reach the cordons (11) and (11*a*), located respectively within the air-filled portions of housing (1) and of liner stub (5)**.

Conversely, the firing system used for the secondary explosives preferably uses a larger-diameter wireline tool, comprising another detonator-slapper connecting device, inserted through cavities **(2*a*) and (2) to reach the sealed starting ends of primacords affixed to the upper end of liner stub (5), now fully extended and cemented. These primacords lead to the secondary explosives (27) in their protective elliptical enclosure, affixed to the inner surface of the liner stub (5)**, along its annealed and machined edge.

Because the wireline tool used to fire the secondary explosives fits closely over the upper end of stub (5), in order to connect the detonator-slapper to the primacord ends leading to the secondary explosives, the larger wireline tool may also carry the secondary explosives themselves, except in those small parts of the elliptical ring of secondary explosives which are shielded by the tubes of inner cage (8). This option practically eliminates any risk of damage to the drillable protective cover and to the secondary explosives by any of the wireline fishing tools and by any drill bits used respectively for debris removal and for supplemental drilling of the side pocket hole besides that done by the jet-drilling nozzles (14). This option is especially desirable when the formations penetrated by the side pocket hole are relatively hard, making the jet-drilling process less efficient.

There are, however, other safe types of firing systems, which do not require wireline tools. The exact type and location within the assembly of these firing components have not been specified, but it will be apparent to those skilled in the Art that this omission does not detract from the basic concepts of the present Invention, because such types of firing systems are already in use for the perforation of well casings and for other tasks requiring explosives downhole.

Figure 12:
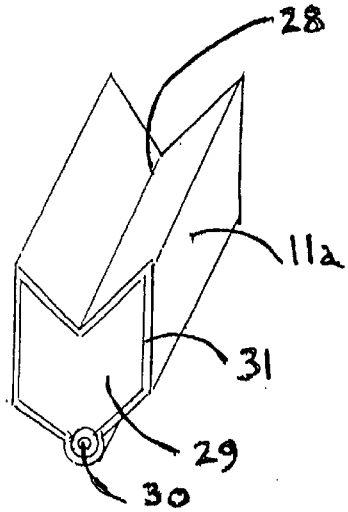
FIG. 12 is a transverse cross section of an explosive cutting cordon.

FIG. 12 is a transverse cross section of the linear cutting cordons (11) and **(11*a*). It shows in particular their axial "V" shaped groove covered by a thin metallic liner (28). The detonating cord (30) is located at the opposite end of the "V", in close contact with the molded charge of military high-explosive (29), which is available from various manufacturers. The backing material (31) of the cordon is preferably a thin metal sheet, continuous with the liner material, so that the explosive is totally sealed between its liner and backing materials. For cordon (11), this is a secondary seal, behind that provided by the elliptical cover ring (20). The flow communication between groove (12) and the housing lateral surface grooves (23) is initially plugged-off. It is opened only as a secondary result of the back-end shock wave created by the explosion of cordon (11) within groove (12). This flow channel, opened by the explosion, also provides a preferential exit path for the explosion fumes, via the liquid-filled casing/work string annulus, to the surface. On the contrary, the fumes from the explosion of cordons (11*a*)** reach the surface at a later time, primarily via the partly air-filled work string, which, then, gradually begins to fill-up with casing fluid.

Figure 13:
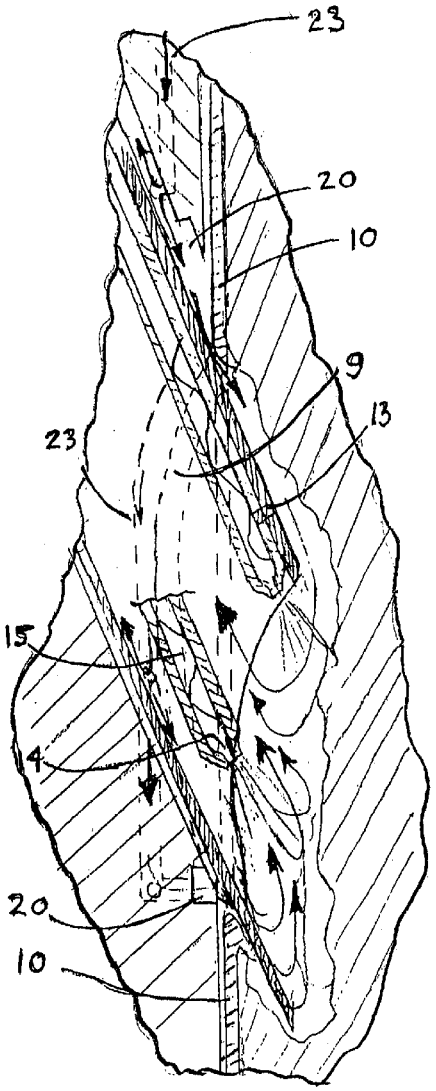
FIG. 13 is a vertical cross section of the liner stub Assembly in the windowed casing, showing the casing fluid flow during the jet-drilling of the side pocket, by multiple fixed nozzles, before the full extension of the liner stub.

FIG. 13 is a vertical cross section of the liner stub, partly penetrating into the shattered formation, after the successive explosions of cordons (11) and **(11*a*) and after removal, by wireline, of the debris from cover plate (19) and from the remains of casing (10), through the window (9)**, created by these cordons explosions. It is assumed that the well is then under reverse circulation and that jet-drilling of the side pocket is in progress. The corresponding flow paths of the casing fluid are indicated by arrows. The following displacement of a cement slug around the fully-extended stub starts as soon as the side pocket is completely drilled.

Figure 14:
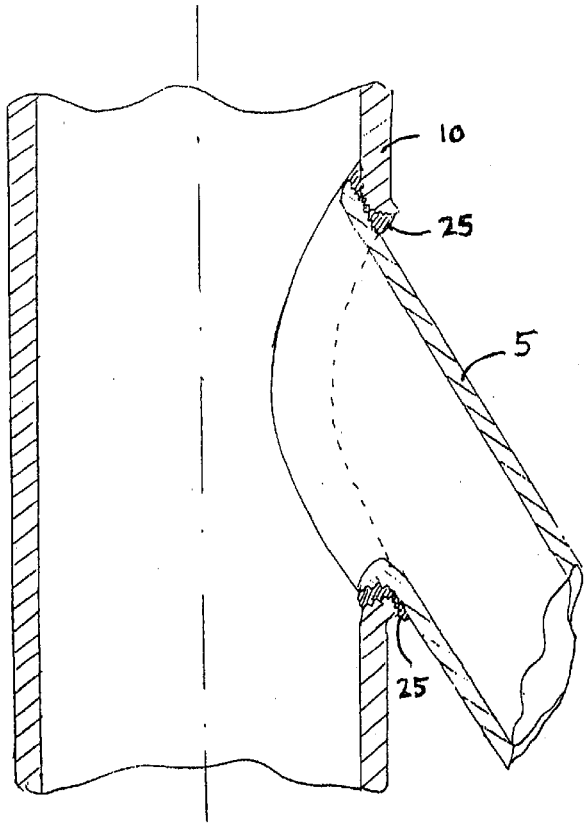
FIG. 14 is a detailed vertical cross section of the weld between liner stub wall and casing wall at the upper end of the window's edge, obtained by using the Assembly, in this First Embodiment.

FIG. 14 is a transverse cross section of the explosively-bonded junction of the upper end of the liner stub (5) to the windowed casing (10), along the edge of window (9). This cross section is taken at the lowest point of window (9). It shows a slight enlargement of the annealed upper end of stub (5) and the sealing contact zone provided by the crushed wave soft metal collar (25). Both features result from the firing of the secondary explosives (27). The charge's protector ring (26) has been shattered into small fragments (not shown), by this final explosion. This completes the quick installation of stub (5), in an existing cased well, by means of the pre-fabricated liner stub assembly, in the First Embodiment of the present Invention. The features which contribute to the low cost of such a high-quality branch lateral connection have been outlined to show the commercial value of this improvement over the existing multi-lateral well technologies aimed at comparable performances of the equipment, downhole.

It will be apparent to those skilled in the Art that some minor design variations are possible, including the use of most types of surface-controlled firing systems, triggers, detonators, fuzes, etc . . . , without departing from the basic concepts of the present Invention. Its application to a 7" OD, 20 #/ft casing, chosen for illustration only, is not restrictive. Larger and smaller existing cased wells may also benefit from its use.

Functions of the Assembly in the Second Embodiment Shown on FIG. 15 to FIG. 20

In the Second Embodiment, the liner stub enters into the side pocket hole by a downward vertical translation of the top half of the Assembly, in which the stub is held, combined with a slight rotation, of less than one degree, around a horizontal axis located at the uppermost point of the collar-equipped stub. The axis of rotation is materialized by the flexion of a hinge-like metal strap which is respectively affixed at one end to the top point of said stop-collar and, at the other end, held in a vertical lateral groove cut in the upper part of a two-piece drillable housing, above the apex of a notched cavity in said housing. The shape of the main cavity is such that it entirely contains the liner stub, equipped with a stop-collar of variable width, designated as a collar-apron. Said notched cavity presents two large windows in diametrally-opposed parts of the lateral cylindrical surface of said housing, of sufficient dimensions that the fully equipped liner stub and collar-apron can laterally swing out of said cavity by flexion of the strap at the top of the cavity.

On the opposite side of the strap, the main cavity presents a slight overhang over the edges of said collar-apron, for protection against shocks to the secondary explosives affixed to said collar-apron.

The cavity in the top piece of the cylindrical housing presents an enlarged diametral window in the bottom of said top piece, of width slightly larger than that of the collar-apron, and a stub-locking device.

Said window opens into a second cavity, located above the bottom piece of said housing, so that tools run in the work string through the liner stub, hung in a vertical position, can easily reach said second cavity. The second cavity, when the assembly is run in the liquid-filled casing, consists of a portion of said casing's space, limited respectively by the base of said top piece of housing and by the top of the bottom piece of the housing, equipped with a retrievable hanger-packer.

Within said second cavity is a plurality of vertical telescopic rods and tubes or grooves, which, in their extended position, provide the structural linkage and support between the top and bottom pieces of said housing, when said assembly is run-in and set in the existing liquid-filled casing. When in their retracted position, said telescopic rods and grooves bring the base of the top piece in direct contact with the top of the bottom piece, anchored and sealed by the hanger-packer, thus collapsing the second cavity. In its run-in and locked position, the fully opened second cavity contains, directly centered on the vertical of the liner stub strap and affixed to the respective bases of the two housing pieces, all the required explosive cutting cordons, enclosed in pressure-resistant drillable housings. They form a three-dimensional template of dimensions comprised between respectively those of the liner stub outer surface along its upper end and those of the collar-apron's outer edge, so as to provide a small overlap between the casing's inner surface around the explosively-cut window and the outer face of the collar-apron. The second cavity also contains most of the firing system for the elliptical cordon of explosive cutting charges and for the straight linear cordons of cutting charges. In addition, the second cavity contains a special firing system to unlock and collapse the telescopic linkage between both pieces of the housing, the function of which is outlined below.

Subsequent to the detonation of said cutting charges and to the removal of all debris by wireline tools, via the liner stub, and to the drilling of a side pocket hole through the casing window, the liner stub is extended into said pocket hole in a complex motion. Said motion includes a downward telescopic translation of the upper part of the housing, caused by unlocking and retracting the telescopic supports, by suitable means (mechanical, hydraulic or explosive), while the work string supporting said housing is slowly lowered down to the lowest level of the window explosively cut in the casing.

Said downward translation is combined with a guided slight rotation of the liner stub from the hinge-like strap, located in said upper part of the housing. As a result, the metallic collar-apron around the upper end of said liner stub is pressed against the inner wall of the casing around the explosively-cut casing window.

A slug of cement slurry is then displaced in the pocket hole behind the stub wall, using conventional cementing plugs.

The collar-apron is then explosively bonded to said casing by the secondary explosive charges affixed to said liner stub's upper end.

Said secondary explosives, used for bonding collar-apron to casing, are separately detonated by a firing system located in the top piece of the housing and triggered from the surface.

Detailed Description of FIGS. 15 to 20, Related to the Second Embodiment FIG. 15 is a vertical cross section, in the plane of symmetry AA, of a housing (1) made up of two cylindrical pieces: a stationary bottom piece (1*d*) including the retrievable hanger-packer (24) and a mobile top piece (1*c*), coupled to the work string by the threaded cavity (2*a*) The two pieces (1*c*) and (1*d*) are linked to each other by a collapsible middle part. It is a guiding and support linkage system consisting of several vertical telescopic rods and grooves or tubes (32), of small cross section, extending within an open portion of the casing (10). This linkage system forms a second cavity (2*b*) when the telescopic grooves and rods (32), respectively affixed to the two pieces (1*c*) and (1*d*) of the housing, are in their fully-extended and locked position. The first and second cavities (2) and (2*b*) communicate through a notched opening (33) below the liner stub (5), providing a full-opening path through the liner stub (5), when said stub (5) is locked in the vertical position, tangent to the cylindrical housing surface.

Each housing piece (1*c*) or (1*d*) consists of a drillable cylinder, of diameter equal to the drift diameter of the casing, including various grooves and cavities. The convex upper surface of the bottom piece (1*d*) and the concave lower surface of the base of the top piece (1*c*) closely fit together when all telescopic grooves and rods (32) are unlocked by suitable devices (34) (e.g. explosives) and collapsed within their respective cavities in (1*c*) and in the stationary base of the bottom piece (1*d*) of the drillable housing. The firing system (35) of explosive devices (34) unlocking the telescopic rods (32) also causes the delayed unlocking by mechanical, hydraulic, electrical or explosive means, of the lower end of stub (5) within cavity (2), prior to the lowering of (1*c*) by the work string weight. The outer surface of (1*d*) is equipped with a retrievable hanger-packer (24), providing the same sealing and anchoring functions as in the first embodiment. The top housing piece (1*c*) presents a large cavity (2) containing the liner stub (5), equipped with an outer stop-collar, which, in the Second Embodiment, presents a variable width and is now designated a collar-apron (25*a*). Secondary explosives (27), in a drillable protector ring (26), are affixed to said collar-apron (25*a*).

The liner stub (5), made of high-strength steel, presents a beveled square-cut lower end, but its upper end has the same shape as in the First Embodiment. It is preferably prefabricated using also the same method and tools as those described and claimed in U.S. Pat. No. 6,065,209. The liner stub (5), with its welded collar-apron (25*a*) and the secondary explosives (27), also used for bonding, is located in a cavity (2) ending in two joined windows (3) and (4), respectively on the lateral surface of (1*c*) and in a diametral part of the base of (1*c*). Housing window (4) communicates with the cavity (2*b*) separating (1*c*) and (1*d*) prior to the detonation of all the explosive cutting cordons (11) and (11*a*). Said cordons, located in cavity (2*b*), are used respectively for cutting the periphery of the required window (9*a*) in the casing and for cutting casing remains into narrow strips, suitable for removal by wireline via the liner stub (5) and the work string.

The main difference, in the Second Embodiment, is the different type of motion (a combined translation and rotation, instead of a simple translation) required to extend liner (5) into the entrance of the side pocket drilled through window (9*a*). This difference results not only in a different shape of the respective collars, (25*a*) versus (25), but also in a different shape of the window (9*a*), compared to window (9) of the First Embodiment. During this partial extension of the stub, the apron end of stub (5) is prevented from axially rotating by guiding means on the bottom and sides of cavity (2). Once engaged in the pocket hole, the liner stub's bottom end is thrust into the hole, until the collar-apron (25*a*) rests against casing window (9*a*). Controlled thrusting forces may be created, by means of a retrievable plug set in said bottom part of stub (5) while slowly increasing fluid pressure in the work string with respect to that of the casing, thus causing the spring-loaded suspension strap (36) to un-coil, while the the work string is lowered, until full contact of collar-apron (25*a*) to casing is achieved and the housing pieces (1*c*) and (1*d*) rest upon each other and lock together.

The concave shapes of the roof of cavity (2*b*) versus the convex top of (1*d*) and the location of the center of gravity of the welded assembly of the stub and collar-apron, away from the vertical of its suspension point, all contribute to guiding the lower end of the stub (5) into a slightly tilted position to easily enter through the casing window (9*a*) into the side pocket hole. When the square cut end of stub (5) comes in contact with the convex top surface of housing (1*d*), it is deflected radially outward by the friction force generated at the contact point, tangentially to the convex surface, until it is stopped by the collar-apron (25*a*), resting against the casing window's edge.

Secondary explosive charges (27) are then fired from the surface to obtain a bonded seal all around window (9*a*). The included secondary firing system (38) is preferably triggered by a further increase in the work string pressure, after the full extension and cementation of stub (5) have been achieved. The retrievable plug is then removed by wireline from the liner stub (5) and drilling of the deviated hole, through liner stub (5) welded to window (9*a*), begins, using any of the drilling means indicated in the First Embodiment.

Liner completion of the branch well is conventional, as in the First Embodiment. When a small size hanger-packer has been set in the fully tubular lower end of the cemented and sealed collar-apron and stub assembly, the hanger-packer at the bottom of said apparatus is unlocked and pulled out at the end of the work pipe string, using sufficient force to break the stub's suspension strap (36), leaving nearly full access to the casing space below the branch well.

It will be apparent to those skilled in the Art that, although the telescopic tube and rod guiding system, shown on FIG. 16, comprises two mobile parts, respectively penetrating into cavities in housing pieces (1*c*) and (1*d*), the same type of guiding may include fewer parts, retracting into cavities in a single piece of the housing. Said cavities may also be limited to simple grooves on the lateral surface of said housing, without departing from this Invention.

FIG. 16 is a horizontal cross section (to scale) of a well casing (7" OD, 20 #/ft) containing an Assembly of 6.33" OD equipped with a 4.5" OD liner stub for the Second Embodiment. It shows the lower part of the upper cavity (2) of the housing (1*e*) containing the liner stub (5) in its fully retracted and locked position, parallel to the axis of the housing (1*c*). The bottom part of the collar-apron (25*a*), of 6.45" OD, welded to the upper edge of the liner stub (5) is also shown. The angle formed between the axis of the stub and the axis of the cylindrical part of the apron is 0.5 degrees, thus providing a 24" length of fully tubular portion of the stub, sufficient for setting a conventional packer to seal the connection between the upper end of a 3.5" OD liner string and the 4" ID of the liner stub. The annealed edges of the apron are curved back so as to fit within the housing (1*c*). In this fully-retracted position of the liner stub, the maximum width of the collar-apron is 4.75". It is thus sufficient to stop the extension of the liner stub into the cut-out casing window of 4.55" maximum width. The 0.10"-wide overlapping edge surfaces of the collar-apron and of the casing inner wall, around the window's edge are explosively straightened and bonded by secondary charges (27) to provide a tight seal at the junction of the vertical casing with the vertical collar-apron, welded to the slanted liner stub. A 3.5" OD liner string, used for the completion of the branch well, will later be hung and sealed in the liner stub, preferably using the Apparatus described in the Fourth Embodiment of the Invention.

The telescopic rods or tubes (32), linking the top piece of the housing (1*c*) with its bottom piece (1*d*) are shown in FIG. 16 in vertical lateral grooves of the drillable housing. Locking devices (34), maintaining the two parts of the housing in their separated positions, may be de-activated by various means (explosive, hydraulic or mechanical) in order to collapse the upper part of the housing against the lower part of the housing. This collapse, accompanied by the gradual lowering of the work pipe string, causes the guided translation-rotation motion of the unlocked stub through the cut-out casing window and into the side pocket, after detonation of all the linear cutting cordons and subsequent removal of debris and drilling of the side pocket.

The casing window's edge and the collar-apron (25*a*) are explosively bonded together by detonating the secondary explosives (27), by means of primacords (41) located on the inward edge of secondary explosives (27) affixed to the collar-apron (25*a*) and using a separate detonator and firing system (38), independent from that of the linear cordon-type cutting charges (11) and (11*a*), as in the First Embodiment. The protective enclosure (26) of the secondary explosives (27) affixed to the collar-apron (25*a*) are also shown.

FIG. 16*a* is a transverse cross section of the casing (10) and liner stub (5) after said liner stub has been extended out through the lower part of casing window (9*a*) and cemented into the side-pocket hole. It shows a cross-section of the explosively-bonded collar-apron (25*a*) after explosion of secondary charges (27) and after retrieval of the housing pieces (1*c*) and (1*d*), locked together. The soft metal (25) in the bonded area is also shown on the outer face of the collar-apron (25*a*), with the characteristic wavy interfaces with its adjacent steel elements.

FIG. 17 is a perspective sketch of the liner stub (5), viewed from the collar-apron (25*a*) face. It also shows the protector ring (26) of the secondary explosives (27) and the beginning of the liner stub suspension strap (36).

FIG. 18 is a perspective detailed view of the right bottom corner of the apron part of the collar-apron (25*a*), covered with a soft metal layer (25), at the edge on its outer surface. It also shows drillable protector ring (26), filled with secondary explosives (27), at the edge of the inner surface of said collar-apron. The protector ring is cut-out on the drawing to show its inverted "U" shaped cross section.

FIG. 19 is a perspective sketch of the cavity (2) in the top piece (1*c*) of the housing, viewed from the outside. It shows the groove (37) in which the suspension strap (36) is located, between the inner surface of the casing and the outer cylindrical surface of said top piece (1*c*).

FIG. 20 is a perspective view of the casing window (9*a*), showing the liner stub (5) and the outer edge of its collar-apron (25*a*), explosively-bonded to the inner surface of casing (10), around window (9*a*).

It will be apparent to those skilled in the Art that, despite a few differences between the first two embodiments, they both proceed from the same basic concepts and achieve similar results, at comparable costs.

The additional space required by the wide apron end of collar-apron (24*a*) within cavity (2) in the Second Embodiment, however, reduces the kick-off angle by 30% to about 0.5 degrees for a 7" OD (20 #/ft) casing and a 4.5" OD liner stub. This would result in a small increase in cost of the branch well, in the work-over's itemized total Capital cost.

In its fully-retracted position, the full length of the assembly for the Second Embodiment, is reduced to 51 ft, which can easily be handled by most derricks, but it becomes about 98 ft, when fully extended, in its run-in position. This makes it more difficult to handle in a small rig. The cost of the prefabricated assembly is also increased by about 30 m, because of the added complexity of forming, machining and welding the collar-apron to the stub's upper end.

In the First Embodiment, the work string used with this Assembly may remain empty, prior to the cordon firing step, to be filled later. In the Second Embodiment, the work string is liquid-filled from the beginning. The associated pocket hole is preferably jet-drilled in the First Embodiment. In the Second Embodiment, the side pocket hole is preferably drilled with an asymmetric "kick-off" bit, at the end of a rotary drill string, or by a bottom hole assembly including a mud motor and a bent sub, because of the different shape of window (9*a*) and of the required shape of the pocket hole entrance.

These minor differences in installation procedures may dictate the preferred use of the First Embodiment apparatus in low-pressure wells, penetrating relatively soft formations, and that of the Second Embodiment of the apparatus in higher pressure wells, penetrating harder formations.

Functions and Limitations of the Assembly in the Third Embodiment

In a Third Embodiment, the connecting tube to the branch well is no longer a mobile straight liner stub displaced out of an existing casing, through the casing window, into a side-pocket hole, but a stationary pre-curved liner assembly, compatible with a small-diameter by-pass tubing, clamped inside the casing and explosively-bonded to the inner surface of the casing wall, along the edge of an explosively-cut casing window.

Access to the casing space below the connector tube assembly is now restricted to the small-diameter by-pass tubing, but this compromise allows to greatly simplify the Apparatus and to reduce the costs of its shop pre-fabrication and of its installation in a cemented cased well. The stub-guiding system is eliminated, thus reducing the volume of debris to be removed by wireline. The length of explosive cordons required in the apparatus is also reduced because the window-cutting operation and the explosive-bonding process are performed simultaneously by the same cutting cordon. The method of pre-fabrication of the Pre-curved Liner assembly is described and claimed as the fourth embodiment of Co-pending U.S. Pat. No. 6,065,209.

The main advantage of the pre-curved liner assembly is that, remaining stationary in the casing, it provides most of the functions of the housing (1) of the previous embodiments, under its various forms (1*a* and 1*b* or 1*c* and 1*d*). Consequently, the Assembly housing is eliminated in the Third Embodiment.

As in the previous two embodiments of this Assembly, the close-fitting tolerance achieved by this method of pre-fabrication is a pre-requisite to the reliability of the explosively-bonded seal at the junction of the casing to the Pre-curved Liner. The accurately-machined surface of the lower end of the Pre-curved Liner is firmly pressed against the inner surface of the clean, scale-free, casing, by suitable eccentering devices. The inner edge of the Pre-curved Liner serves as a template and aiming support for the explosive cutting cordon, so that the jet resulting from these shaped charges' explosion hits the inner surface of the casing wall at the prescribed angle required for both cutting the casing window and welding the end of the Pre-curved Liner to the window's edge. The cutting cordon is similar in concept to cordons (11) and (11*a*) of the First and Second Embodiments, but its technical characteristics are different. The critical jet angle is a function of the characteristics of the explosive, of the jet velocity and of the two metals in contact. These characteristics determine the required shape of the three-dimensional surface of the jet trajectory in the casing and, consequently, the required aiming and bending of the explosive cutting cordons, of cross section shown on FIG. 9BB.

The explosion takes place within an air-filled enclosure at atmospheric pressure, so as to form the cutting jet independently of the well pressure prevailing outside the sealed enclosure. The pressure-resistant sealed enclosure is made-up of the machined Pre-curved Liner, equipped with transverse internal tie-rods matching the stiffening ribs of a drillable cover plate equipped elastomeric seals. The upper end of the pre-curved connector tube is tangentially pre-welded to a thick circular metal plate of diameter equal to the drift diameter of the existing well casing. The by-pass tube is pre-welded at its upper end either directly to the end plate or to a the edge of small elliptical window machined on the lower side, outside of the Pre-curved Line. The upper end of the end plate connector tube is equipped with coupling threads matching those of a work string used for running-in, orienting and installing the Pre-curved Liner Assembly at the prescribed scale-free location in the existing cemented casing.

Detailed Description of the Third Embodiment (FIGS. 21, 21AA, 21B and 21BB)

FIG. 21 shows the sealed enclosure consisting of a Pre-curved 4.5" OD Liner stub (41), with a large radius of curvature, typically 100 to 200 ft in a 7" OD casing, equipped at its upper end with a tangentially welded thick plate (42), used as a guiding stiffener, and at its annealed lower end with a precisely machined elliptical drillable cover plate (47) cut from a cylindrical surface of same diameter as the inside diameter of the casing (10). A steel collar (25), similar in shape to the stop collar disclosed in the First Embodiment and machined in the same way, is welded to the cylindrical outer surface of the connector liner (41), along its machined edge and annealed. In addition, a plurality of transverse tie ribs made of drillable material, are installed in the shop during the machining of said lower end, to further stiffen the lower end of the Pre-curved Liner Assembly and to prevent its deformation during handling at the well site and during the running-in, orienting and downhole clamping of the Pre-curved Liner Assembly. Consequently, the edge surface of this tubular opening closely fits with the casing's inner surface, when they are pressed together by an eccentering device (45). A drillable cover plate (47), stiffened by transverse ribs matching the tie ribs and equipped with an "O" ring seal at its elliptical periphery, hermetically closes the lower end of the Pre-curved Liner assembly. The cover plate (47) is similar in concept to the cover plate (19) of the First Embodiment, except for minor details.

An elliptically-curved, "V"-shaped linear explosive cutting cordon (48), including a metal liner (49) is aimed and affixed to the ribs of cover plate (47), with a prescribed stand-off distance from the outer surface of said cover plate, complete with its associated Primacord, detonator (53) and surface-triggered firing system (54). When the ribs of cover plate (47) are affixed to the tie ribs (55), to seal the bottom end of the Assembly, and clamped against the inner surface of the casing (10), the downhole firing of cordon (48) performs simultaneously two operations: the plasma jet of explosion gases, loaded with metal from the cordon's liner (49), in liquid and vapor phases, firstly, cuts obliquely into the casing (10) a window (9) along the outer edge of the cover plate (47), serving as a template, and, secondly, its extremely high impact pressure explosively bonds together the edge of the window (9) to the edge of the Pre-curved Liner's lower end, and to its welded collar (25), thus providing a sealed connection at the junction of the liner stub (41) to the casing (10), as in the previous two other embodiments.

In cases where it is desired to strengthen the area of the bonded junction between casing and connector liner stub, secondary explosives (27) are affixed to the inner surface of collar (25) and protected from the well fluids by a drillable cover ring (26). They are detonated simultaneously with the elliptical cutting cordon (48), using the same detonating cord (52). This feature allows to greatly increase the explosively bonded area of the sealed junction and/or to reduce the weight of explosive in cordon (48). It is especially relevant to existing casings of marginal thickness in regard to the prevailing overburden pressure.

After a short delay, caused by fuze (52), from the explosion of metal-lined cordon (48), a straight "V"-shaped explosive cordon (49*a*) devoid of metal liner in its "V" surface, affixed to the ribs of the cover plate (47) along its vertical centerline, is also detonated downhole. Its function is to fold in half vertically the remains of the casing (10) and those of the cover plate (47). The resulting elongated but narrow debris can then be removed by magnetized wireline fishing tools run-in through the work string into the Pre-curved Liner tube.

The thick end plate (42) welded to the upper end of Pre-curved Liner (41) presents a small by-pass hole (46) through which a parallel tubing may be inserted for connecting to a pre-installed conventional casing packer for a single tubing, set below the lower end of the Pre-curved Liner Assembly. In this way, the perforated interval of the casing (10) below said casing packer may be linked to the surface, by a separate tubing, for the operation of the original cased well, independently from that of the added branch well.

FIG. 21AA is a horizontal cross section in plane AA of the guiding plate (42) at the upper end of the Pre-curved Liner Assembly. It shows the by-pass hole (43), adjacent to the straight upper end of the pre-curved connector stub (41), within the cemented casing (10). The elliptical cutting cordon (48) and the straight folding cordon (49*a*) are also indicated in cross section to show their respective aiming angles with respect to the radii of the casing (10).

In small-diameter casings, the by-pass tubing may be located within and below the connector stub (41). In such a case, the by-pass tubing is welded to the outside surface of the pre-curved stub, on its lower side, along the edge of a narrow elliptical window presenting an apex in the straight upper part of said Pre-curved Liner (41). In that case, the guiding plate (42) is preferably replaced by a conventional dual-tubing casing packer.

FIG. 21B is a view from the back of the cordons (49) and (49*a*) and of the inner surface of the cover plate (47). It shows the transverse ribs, prior to fastening them to the matching tie rib stiffeners (55) across the opened lower end of the connector stub (41).

FIG. 21BB is a detailed cross section in the horizontal plane BB of FIG. 21B, showing the tight fit between the cover plate (47) and the casing (10) and the oblique angle of orientation of the cutting cordon (48) toward the outside of the Pre-curved Liner, with respect to the vertical center plane of opening (9), sealed by cover plate (47). The metallic housing (50) of the explosive charge (48) and the "V"-shaped metal liner (49) of the charge in the curved cutting cordon are also shown.

Functions of the Apparatus of the Fourth Embodiment Shown on FIGS. 22, 22A, 22AA , 22B and 22C.

The first function of the Combined Apparatus is to guide and install a liner string in the branch borehole to be drilled through the cemented and welded liner stub.

The other functions of the Combined Apparatus are to drill the highly-deviated branch borehole and to guide and install the liner string into it, while providing the means for circulating drilling and completion fluids and for transporting cuttings from the sand face to the surface.

The Combined Apparatus for this Fourth Embodiment is shown on FIGS. 22 to 22C. It is equally compatible with each of the stubs of the previous three embodiments, even if FIG. 22 only refers to the First Embodiment.

Detailed Secription of the Over-All Apparatus (see FIG. 22)

A segment (56) of coiled tubular, used as liner string, of length sufficient to reach the targeted depth from the kick-off point of the planned branch well, is inserted in the work string. Its upper end is equipped with a liner hanger (57) and a hydraulic packer (58) of diameter suitable for setting it in the stub (5). It remains suspended to a steel cable (59), uncoiled from a winch (60) at the surface. The liner's lower end, presenting a series of small lateral openings (71) is then inserted into the cemented stub and thrust against the excess cement top.

A steerable jet-drilling nozzle system (61), of the kind disclosed and claimed in U.S. Pat. No. 5,402,855, is inserted in a coiled tubing umbilical (62) comprising electrical conductors, such as that of claim 22 of said US Patent, and made of glass or Carbon fibers composited with low-density plastic resins, or such as those currently available in the US from the Fiberspar Spoolable Products, Inc. of Houston, Tex. and in Canada from Thread Tech Tubular Products.

Alternatively, the umbilical may consist of a thin-walled metallic coiled tubing core, made of a low-density metal, such as Titanium, encased in a re-inforcing hose, made of pre-stressed fibers of a low density plastic, such as Kevlar, and covered by a protective layer of flexible plastic, such as polyurethane.

The relatively over-all low density of this tubular umbilical is further reduced, in its lower part, by a buoyant outer-layer (63) of "syntactic" flexible resin filled with micro-bubbles, made of a pressure-resistant material, such as fused silica. A similar composite is available from the Balmoral Group, of Aberdeen, U.K. under the Trademark of "Thermcast".

The resulting effective weight of the composite umbilical is near zero in a highly concentrated salt solution or in a low-solids heavy drilling mud of the kind required for drilling horizontal wells in soft formations.

The lower part of said umbilical serves as the nozzle housing (68) of all the devices comprising the jet-drilling assembly, namely a surveying module (64), which determines its spatial orientation, and a steering module (66), which aims the nozzle (65) accordingly, in order to achieve a prescribed borehole trajectory.

The outer surface of nozzle housing (68) presents a plurality of grooves (67) carrying the fluid from the annular between the composite umbilical (62) and the inner surface of the metal liner into the annular between the liner (56) and the borehole. This stream carries cuttings, chipped off by the jet-drilling process, to the surface, under a "direct" mud circulation.

A characteristic of this jet-drilling process is that the borehole diameter, in relatively soft rocks, is significantly larger than the liner diameter. Consequently, the liner (56) can advance into the borehole, at a short distance behind the jet-drilling nozzle (65). The liner segment (56) is pushed downward by the force of the mud's hydraulic pressure, typically 500 psi, applied to the annular cross section of the partially expanded packer (58) in the work string, plus the liner's effective weight and minus the tension of the cable (59) to which it is suspended.

Conversely, the lower part of the umbilical (62) is pushed downward by the force of the mud hydraulic pressure, applied to the annular cross section of nozzle housing (68), plus the the force of the drilling stream's hydraulic pressure, 5,000 psi or higher, applied to the inner cross section of the umbilical (62), minus the net recoil force of the jet nozzle, and minus the tension in the coiled umbilical, if the effective weight of this umbilical is negligible. The spooling device of the umbilical is equipped with brakes and is driven by a variable speed motor (not shown).

In such a system, the rate of penetration of the jet nozzle into the formation and its trajectory are controlled independently of the rate of penetration of the liner into the borehole. The most buoyant lower part (63) of Umbilical (62) acts as an internal guide for controlling the trajectory of the liner by lifting the liner's end into the previously drilled borehole.

FIG. 22 shows a partly inflated hydraulic packer (58) acting as a piston driven by the hydraulic pressure of the mud stream, injected at the surface by a mud pump into the work string (69) and returning to the surface, by direct circulation, from the branch borehole, via the annular space around the liner (58) and via the annular space in the casing, around the work string (69). The force applied to the cross section of packer (58), plus the liner's effective weight, thrust the liner into the branch borehole. It is balanced by the tension on cable (59), applied upon the brakes of the surface winch (60). Cable (59) is affixed to the inner wall surface of the liner (56) by a suspension device (70) presenting an axial tubular guide for the spoolable ombilical tubing (62) which feeds the steerable jet-drilling nozzle (61) with a high pressure mud stream. The suspension device is releasable from the surface, by mechanical or electrical means.

The umbilical (62) includes electrical conductors for transmission of power and data from the surface to the nozzle-steering system downhole. These conductors may be located within the wall of the umbilical or within a separate armoured cable run-into the umbilical, from the surface. In either case, any electrical signals required for releasing the suspension device (70) from the top end of the liner (56) may be transmitted by induction, or by other means, from the umbilical (62) to the suspension device (70).

In the event that the bottom part of the liner gets hung on a hard "ledge" or other irregularity of the borehole, a reverse circulation may be established at the surface in the liner (56) to clean out such an obstruction, by carrying debris to the surface at higher velocity, via the annulus between the liner (56) and the work string (69). If this is insufficient, the umbilical is pulled-up by winch (60) and the nozzle (65) back-tracks to the obstruction depth, until it reaches the bottom end of the stuck liner, for a second pass of jet-drilling until the obstruction is removed.

When the branch borehole has reached its targeted depth and the liner hanger-packer has reached its selected position in the middle of stub (5), the drilling fluid circulation is stopped and the umbilical is coiled up to the surface, including the nozzle housing.

The liner hanger (57) is mechanically or hydraulically set in stub (5) and the liner suspension cable is disconnected and pulled out.

This requires that the suspension device (70) be released from the liner by mechanical means, (a "go-devil" dropped from the surface, for instance), or retracted by an electrical signal transmitted via the umbilical (62) to electromagnetic means in the liner hanger.

The branch well is then ready for gravel packing and for liner cementation, by conventional means.

A work tubing is inserted into the hung liner (56) for successive placements of gravel, in the bottom part of the annulus, and of a cement slurry, in its upper part. The packer (58), at the top of liner (56) is also hydraulically set in the liner stub.

The well is then ready for additional perforation of liner (56), preferably as taught in U.S. Pat. Nos. 5,462,120 and 6,065,209.

Prior to the situation shown on FIG. 22, preliminary operations have been performed, using the drilling rig's equipment, by known means to:

- insert the ombilical, at the surface, into the the coiled liner, through its drum shaft,
- couple the umbilical end, emerging from the coiled liner's drum-side end, to its buoyant lower end (68), including the steerable nozzle, and spool-in said lower end, into the drum-side end of the coiled liner,
- guide and straighten the liner's drum-side end through the work string pack-off and down into the work string,
- un-coil the liner from its drum, until a liner segment, of length equal to the distance from the liner stub (5) mid-point to the targeted end of the branch well, has been inserted into the work string,
- temporarily hang the liner into the well head and cut-off the un-coiled liner segment from the remainder of the coil on the drum, using an external pipe cutter,
- affix the cut-off end of the liner to its suspension cable (59) by means of its retrievable internal holder (70), which encircles the umbilical string.
- connect the mud pump to the work string inlet and the high-pressure pump to the ombilical inlet, so as to start the jet-drilling operation.

This sequence, corresponding to the case when the liner segment is shorter than the kick-off depth of the branch well, is slightly modified, when the liner segment is longer than the kick-off depth.

It will be apparent to those skilled in the Art that such minor variations in the order of some of the preliminary operations described above, using known equipment, do not alter the scope of the Invention.

Although the Combined Apparatus was disclosed herein for the case of a liner stub of the First Embodiment, similar types of Combined Apparatus may instead include either the liner stub Assembly of the Second Embodiment or the curved liner stub Assembly of the Third Embodiment, to achieve comparable results, with only minor changes and using the same basic concepts.

Such procedural or equipment changes, in the case of a Combined Apparatus resulting from the Second and Fourth Embodiments, include drilling the side pocket hole, to receive the liner stub, by means of the sterable-jet nozzle and spoolable umbilical, as a substitute to a plurality of on-board fixed-jet nozzles. The same is true for a Combined Apparatus resulting from the Third and Fourth Embodiments. In that case, there is no side pocket hole to be separately drilled. In both cases, the use of the same buoyant grooved lower part of the umbilical is made possible by the temporary addition of centralizer rings around the grooved portion, to compensate for the difference in the inside diameter of the liner stub, as compared to that of the liner segment. After the installation of the liner stub in its side pocket hole, the umbilical is spooled-up to the well-head and the centralizer rings are removed, prior to the insertion of the umbilical inside the smaller-diameter coiled liner.

Detailed Description of FIGS. 22A to 22C.

FIG. 22A is a vertical cross section of the upper part of the branch well liner segment (56), suspended to a cable (59) by means of a suspension device (70). There are a number of available tools, designated as tubular spears, for latching onto the inner surface of heavy oil well tubulars, but they are affixed to a tubular string, rather than to a cable, and operate by rotation of the tubular string. For this reason, a simpler device was designed to handle the lighter load of the liner segment. This device consists of two articulated semi-circular supporting arms (72) and (72*a*), equipped with dogs (76) at their middle, which are pressed into the inner surface of liner (56).

Two extension springs (73) and (73*a*) are affixed by breakable pins (74) to the upper end of arm (72) which is connected to the off-centered cable (59). The lower end of spring (73) is permanently fastened to a pin (75) affixed to the lower part of the other arm (72*a*). The lower end of spring (73*a*) is permanently affixed to the upper end of arm (72*a*). The two extended springs (73) and (73*a*) apply net forces which tend to press the dogs (76) into the inner surface of liner (56), in addition to the tension of cable (59), which also tends to open more widely the lower ends of arms (72) and (72*a*), because any slippage of the dogs (76) against the inner surface of the liner (56) creates a self-tightening torque around the pivots (78) of the articulations.

When a heavy "go-devil", running along cable (59) is dropped from the surface, it acquires sufficient kinetic energy to break down the two upper pins (74), thus releasing the tensions applied by springs (73) and (73*a*). The tension on cable (59) is also released at the surface, so that the lower parts of arms (72) and (72*a*) can retract under the force of a compression spring (77) applied against the upper ends of arms (72) and (72*a*). This allows to pull-out the suspension device and the "go-devil", when liner (56) has been fully installed in the branch well.

FIG. 22AA is a transverse cross section in Plane B'B'. It shows the leaf-type spring (77) providing a small compression force on the upper ends of arms (72) and (72*a*) to retract the dogs. The suspension device and cable are then pulled out and the two arns (72) and (72*a*) are disconnected from each other by removal of their respective articulation shafts (78). This operation allows the retrieval of the jet-drilling device by spooling up the ombilical (62).

FIG. 22B is a transverse cross section of the lower part of the umbilical (62), leading to the nozzle, but sliding within the lower part of the liner (56). Its outer surface presents a plurality of parallel grooves (67) carrying the mud stream from the liner (56) to the annulus around said liner (56). The hydraulic pressure of the mud stream, applied to the annular cross section of the umbilical (62), contributes to pushing the umbilical (62) toward the sand face into the borehole. The outer layer (63) of the grooved surface is made of a buoyant material.

FIG. 22C is a block diagram of the components of the Patented jet-drilling system, located in a buoyant housing (71), affixed to the end of the ombilical (62). The outside diameter of housing (71) is slightly smaller than that of the grooved portion of the umbilical (62), so that it can easily be retracted into the liner, when all mud circulation is stopped or reversed, and the umbilical is spooled-up. The housing contains three or more superposed modules, respectively, from the bottom, the steerable jet-nozzle (65), the steering module (66) and the surveying module (64), all spatially connected by pins in a common orientation groove, as taught in U.S. Pat. No. 5,402,855. These three modules are the minimum required for the jet-drilling process, when the computer controlling the process is located at the surface, as illustrated on FIG. 13 of said Patent. If the control computer is located downhole, at least a fourth module is required, in the portion of the annular space reserved for that module. If the umbilical, largely made of non conductive materials, is also to be used for a "logging while drilling" (LWD) process, additional modules for each type of logging device, plus a power module and a telemetry module for data transmission to the surface, are also added, preferably above the level of the (64) and (66) modules.

All the LWD devices contained in the additional modules of housing (71) are covered by various other Patents. They are powered from the surface via conductive cables imbedded in the wall of ombilical (62) or via an armoured cable co-axial with the ombilical.

Enclosing such a combination of Devices, in said Apparatus including a steerable Jet-drilling system, within a buoyant, non conductive housing, affixed to the buoyant, grooved end, of a spoolable high-pressure umbilical, and run through the same Assembly, presents many cost-saving advantages. These are part of the present Invention's objectives. After the installation of a sealed and cemented liner stub, they provide the means for drilling a branch borehole and for running in a coupling-free liner string, guided through the liner stub (5) by means of the most buoyant part of umbilical (62), and then, hung by hanger (57), gravel-packed, cemented and sealed in the liner stub (5) by the hydraulic packer (58).

While Four Embodiments, including three different types of Assembly and stub designs, have been specifically disclosed, it should be understood that the Invention is not limited thereto, as many variations will be apparent to those skilled in the Art and the Invention is to be given the broadest possible interpretation, reflecting the wide variety of conditions encountered in working-over existing cased wells. For instance, the generic terms of "metal" and "metallic", in the present Disclosure, include alloys and sintered materials, used in conjunction with explosives, some of these materials containing non-metals, such as Carbon, or Nitrogen, combinable with metals, such as Tantalum, Niobium, etc . . . , which are selected for their desirable properties under specific conditions.

Conversely, it should be understood: that the use of conventional drilling apparatus and drivers (rotary, mud motors, fixed nozzles, drill bits, etc . . . ) may also be used, instead of, or in addition to the Apparatus disclosed in the Fourth Embodiment, which includes a Patented steerable jet-drilling nozzle, for some of the functions covered in said Fourth Embodiment;

that the upper part of the spoolable umbilical tubing may be made of a cheaper metallic coiled tubing, made more buoyant by a "syntactic" foam outer layer of very low density;

and that the electrical conductors linking the surface to the surveying and nozzle-steering modules may be located within a multi-conductor cable inserted within the small-diameter spoolable umbilical, rather than in its wall; without departing from the Invention, disclosed herein.

What is claimed is:

1. A pre-fabricated liner stub assembly for adding and bonding a liner stub tubular connector to an existing cemented casing of a well at a subsurface location, said assembly comprising:

an assembly housing, a two-ended liner stub within said housing, said liner stub having an upper and a lower end and including a collar affixed to a selected end of said liner stub, a pre-fabricated template within said housing, said template having a shape closely matching the shape of said selected end of said liner stub and the shape of the interior surface of said existing cemented casing, means cooperating with said assembly for pressing said template against the inner surface of said existing cemented casing at said subsurface location, first explosive means attached to said template for cutting an elongated casing window cut-out opening in said existing casing, means for guiding and applying said selected end of said liner stub and said collar against said elongated casing window cut-out opening in said existing casing, second explosive means associated with said collar for bonding said collar and said liner stub to said elongated casing window cut-out opening in said existing casing, and third explosive means for cutting and folding the remnant debris of said casing and said template produced during explosive cutting of said elongated casing window cut-out opening and said explosive bonding of said collar and said liner stub into said window and within said liner stub.

2. The assembly of claim 1 wherein said first explosive cutting means comprises:

curved linear cordons of liner-equipped explosive-cutting charges affixed to said housing and aimed so that their subsequent explosion within said cased well results in accurately cutting said elongated casing window cut-out opening, said resulting cut-out window opening having a shape similar to said collar affixed to said liner stub and having a dimension smaller than the outer dimensions of said collar.

3. The assembly of claim 1 wherein said second explosive means for bonding comprises:

shaped charges affixed to means within said housing, said charges being aimed so that their subsequent explosion within said housing and against said collar when said collar is applied against said casing at said elongated casing window cut-out opening bonds said collar to said casing.

4. The assembly of claim 1 wherein said third explosive means for cutting and folding the remnant debris comprises:

a straight linear cordon of liner-equipped explosive-cutting shaped charges affixed to said housing and aimed so that said charges cut those portions of said casing and other drillable material within the inner edge of said elongated casing window cut-out opening from said shaped charges into pieces smaller than the drift diameter of said liner stub for removal as debris from said liner stub tubular connector.

5. The apparatus of claim 1 wherein said assembly further includes drilling apparatus for drilling formations outside of said cemented casing and through said elongated casing window cut-out opening and for moving said liner stub into said drilled formation.

6. The apparatus of claim 1 wherein said assembly includes means for coupling said assembly to a tubular work string, said work string adapted for:

a) positioning said assembly in said cemented casing at a subsurface location, b) setting said explosive means, c) removing said remnant debris from said subsurface location, d) and for drilling a lateral well bore from said casing through said elongated casing window cut-out opening.

7. A pre-fabricated liner stub assembly for adding a bonded tubular connector to an existing cemented casing of a well at a downhole position in said well, said assembly comprising:

means for coupling said assembly to the end of a tubular work string for use in running said assembly into said existing casing, a two-ended tubular liner stub having upper and lower ends, said ends being precisely machined and rigid with internal and external stiffening means, a collar affixed to said upper end of said liner stub, first explosive means for accurately cutting an elongated casing window cut-out opening through said casing, said first explosive means attached to a pre-fabricated template having a shape closely matching that of said collar at said upper end of said liner stub, liner stub guiding means for guiding and applying said upper end of said liner stub and said collar against the inner surface of said casing around said elongated casing window cut-out opening, second explosive means for bonding said collar of said liner stub to said inner surface of said casing along said elongated casing window cut-out opening to form a bonded liner stub with said casing, and third explosive means for cutting the remnant debris of said casing and said template into the interior of said elongated casing window cut-out opening and within said liner stub.

8. The apparatus of claim 7 further comprising drilling apparatus passing through said tubular work string for drilling a deviated borehole through said elongated casing window cut-out opening and through said bonded liner stub and for installing in said deviated borehole a segment of a liner string.

9. The apparatus of claim 7 wherein said assembly further comprises:

a steerable jet-drilling nozzle system, a tubular umbilical connecting said nozzle system to a surface pump at the well surface of said existing casing, electrical conductors imbedded within said tubular umbilical, and means for controlling said steerable jet-drilling nozzle system from said well surface for drilling and completing said deviated borehole through said liner stub.

10. A method for forming and sealing the intersection between a primary casing in a borehole and a branch borehole comprising the steps of:

positioning a first explosive means for cutting an elongated window through said primary casing at the position within said primary casing where said intersection is to be located, energizing said first explosive means to cut said elongated window through said primary casing, positioning a liner stub within said primary casing at said explosive cut elongated window, said liner stub including a second explosive means for bonding said liner stub to said primary casing at said elongated window, and energizing said second explosive means to bond said liner stub to said primary casing.

11. The method of claim 10 wherein said liner stub includes a collar cooperating with said second explosive means, said positioning of said liner stub includes extending said liner stub through said cut elongated window for engaging said collar with the interior of said primary casing at said cut elongated window, and said sealing of said intersection is accomplished by bonding said collar to said cut elongated window by energizing of said second explosive means.

12. The method of 10 claim further comprising the steps of positioning and energizing a third explosive means of shaped charges for cutting remnants of said casing produced in explosively cutting said cut elongated window and remnants of said first and second explosive charges into pieces small enough to be retreived from said branch borehole through said primary casing.

* * * * *